US009321282B2

(12) United States Patent
Isozaki et al.

(10) Patent No.: US 9,321,282 B2
(45) Date of Patent: Apr. 26, 2016

(54) DRYING DEVICE, NON-TRANSITORY COMPUTER READABLE MEDIUM STORING DRYING PROGRAM, AND IMAGE FORMING APPARATUS

(71) Applicant: FUJI XEROX CO., LTD., Tokyo (JP)

(72) Inventors: Jun Isozaki, Kanagawa (JP); Akira Sakamoto, Kanagawa (JP); Takehiro Niitsu, Kanagawa (JP); Yasuhiro Ogasawara, Kanagawa (JP); Takeshi Zengo, Kanagawa (JP); Naoki Morita, Kangawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/474,426

(22) Filed: Sep. 2, 2014

(65) Prior Publication Data

US 2015/0251449 A1 Sep. 10, 2015

(30) Foreign Application Priority Data

Mar. 7, 2014 (JP) ..... 2014-045424

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41M 7/0072; C09D 11/101
USPC ..... 347/102
See application file for complete search history.

(56) References Cited

U.S. PATENT DOCUMENTS

2001/0052920 A1 12/2001 Matsumoto et al.
2008/0088689 A1* 4/2008 Korem ..... B41J 11/002 347/102
2009/0021560 A1 1/2009 Miura
2009/0244236 A1* 10/2009 Houjou ..... B41J 11/002 347/102
2009/0284574 A1* 11/2009 Niekawa ..... B41J 11/002 347/102
2011/0228024 A1* 9/2011 Lang ..... B41J 11/002 347/102
2012/0249632 A1* 10/2012 Usuda ..... B41J 11/002 347/9
2012/0287195 A1* 11/2012 Boland ..... B41J 11/002 347/16
2013/0257964 A1* 10/2013 Itogawa ..... B41J 13/0009 347/16

FOREIGN PATENT DOCUMENTS

JP 2002-11860 1/2002
JP 2006-239508 9/2006
JP 4420075 12/2009

OTHER PUBLICATIONS

Abstract and machine translation of JP 2006-239508.

* cited by examiner

*Primary Examiner* — Alessandro Amari
*Assistant Examiner* — Yaovi M Ameh
(74) *Attorney, Agent, or Firm* — Fildes & Outland, P.C.

(57) ABSTRACT

A drying device includes a laser element that irradiates an irradiation region with a laser, the irradiation region including a plurality of droplets on a recording medium which are ejected by an ejection unit, ejecting droplets according to an image, along a transport direction of the recording medium and a direction crossing the transport direction.

11 Claims, 30 Drawing Sheets

FIG. 22

| MAXIMUM FRONT FACE PRINTING RATE RANGE [%] | IRRADIATION INTENSITY SETTING VALUE [W/cm$^2$] |
|---|---|
| $0 < I \leq Cc$ | $I_3$ |
| $Cc < I \leq Cb$ | $I_2$ |
| $Cb < I \leq Ca$ | $I_1$ |

FIG. 28

| LASER ELEMENT NO. | L1 | L2 | L3 | L4 | L5 | L6 | L7 | L8 | L9 | L10 |
|---|---|---|---|---|---|---|---|---|---|---|
| FRONT FACE PRINTING RATE | 20 | 30 | 10 | 20 | 30 | 40 | 20 | 0 | 10 | 20 |
| REQUIRED IRRADIATION INTENSITY 1 | 25 | 50 | 25 | 25 | 50 | 50 | 25 | 0 | 25 | 25 |
| BACK FACE PRINTING RATE | 0 | 0 | 0 | 0 | 40 | 30 | 40 | 30 | 20 | 30 |
| IRRADIATION FACTOR | 1 | 1 | 1 | 1 | 0.8 | 1 | 0.8 | 0.8 | 0.8 | 0.8 |
| REQUIRED IRRADIATION INTENSITY 2 | 25 | 50 | 25 | 25 | 40 | 50 | 20 | 0 | 20 | 20 |

DRYING DEVICE, NON-TRANSITORY COMPUTER READABLE MEDIUM STORING DRYING PROGRAM, AND IMAGE FORMING APPARATUS

CROSS-REFERENCE TO RELATED APPLICATIONS

This application is based on and claims priority under 35 USC 119 from Japanese Patent Application No 2014-045424 filed on Mar. 7, 2014.

BACKGROUND

Technical Field

The present invention relates to a drying device, a non-transitory computer readable medium storing a drying program, and an image forming apparatus.

SUMMARY

According to an aspect of the present invention, it is a drying device includes: a laser element that irradiates an irradiation region with a laser, the irradiation region including a plurality of droplets on a recording medium which are ejected by an ejection unit, ejecting droplets according to an image, along a transport direction of the recording medium and a direction crossing the transport direction.

BRIEF DESCRIPTION OF THE DRAWINGS

Exemplary embodiment(s) of the present invention will be described in detail based on the following figures, wherein

FIG. 22 is a diagram showing an example of an irradiation intensity table;

FIG. 28 is a diagram illustrating a process of setting irradiation intensity of a laser according to the third embodiment;

DESCRIPTION OF EMBODIMENTS

Figure 1:
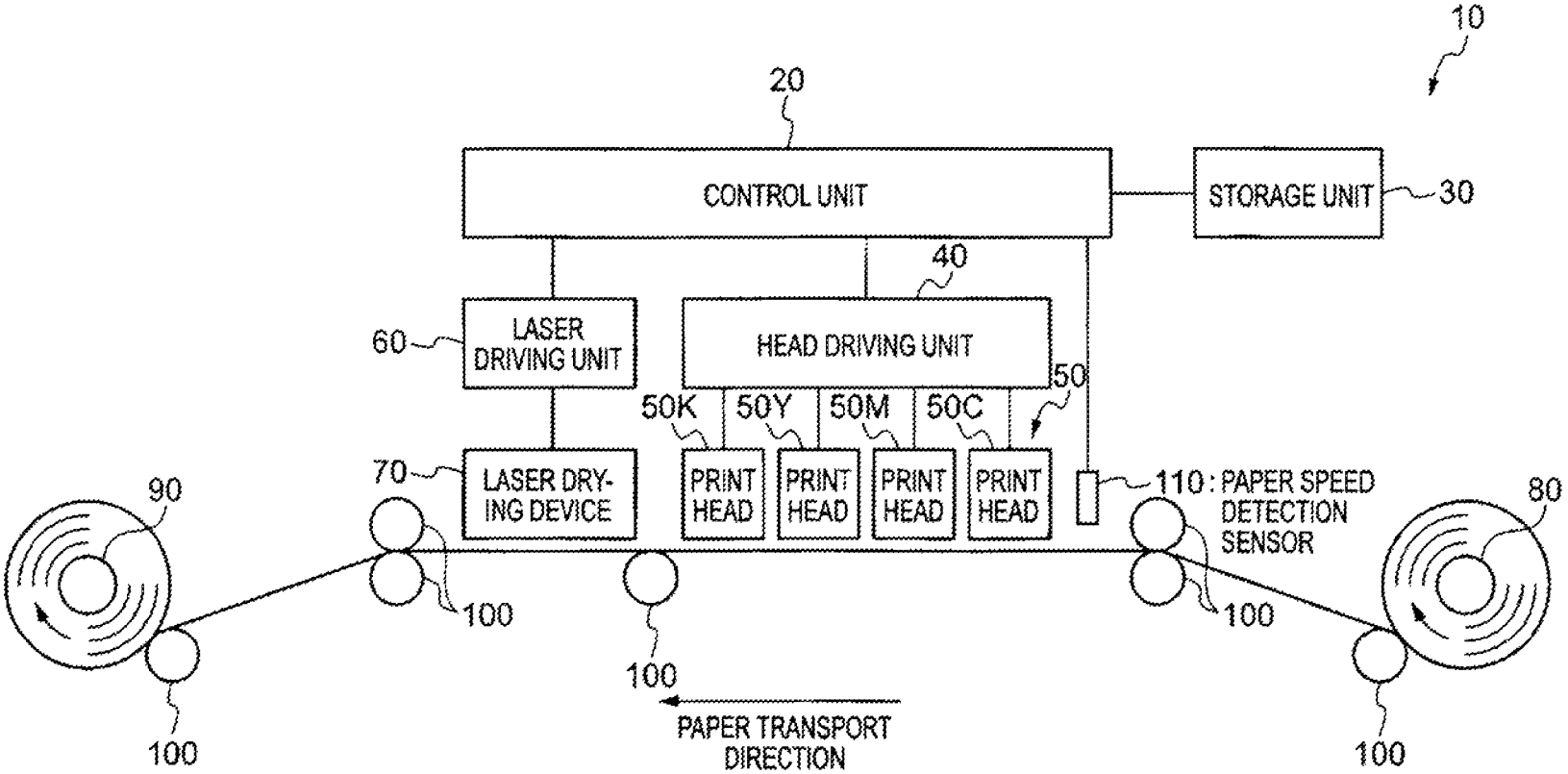
FIG. 1 is a schematic configuration diagram of an ink jet recording device according to a first embodiment and a second embodiment.

Hereinafter, an exemplary embodiment of the present invention will be described in detail with reference to the accompanying drawings. Meanwhile, components and processes having the same operational function will be denoted by the same reference numeral and sign throughout all drawings, and a repeated description thereof may be appropriately omitted.

First Embodiment

FIG. 1 shows an example of a schematic configuration diagram showing main components of an ink jet recording device 10 according to this exemplary embodiment.

For example, the ink jet recording device 10 includes a control unit 20, a storage unit 30, a head driving unit 40, a print head 50, a laser driving unit 60, a laser drying device 70, a sheet-feeding roll 80, a discharge roll 90, a transport roller 100, a sheet speed detection sensor 110, and the like.

The control unit 20 drives a sheet transport motor not shown in the drawing to control the rotation of the transport roller 100 which is connected to the sheet transport motor through, for example, a mechanism such as a gear. The sheet-feeding roll 80 is wound with a long continuous sheet P as a recording medium in a sheet transport direction, and the continuous sheet P is transported in the sheet transport direction in association with the rotation of the transport roller 100.

In addition, the control unit 20 acquires image information stored in, for example, in the storage unit 30, and controls the head driving unit 40 on the basis of color information for each pixel of an image included in the image information. The head driving unit 40 drives the print head 50 connected to the head driving unit 40 in accordance with an ejection timing of ink drops which is instructed from the control unit 20 to eject the ink drops from the print head 50, and forms an image corresponding to the image information on the continuous sheet P which is transported.

Meanwhile, the color information for each pixel of the image which is included in the image information includes information uniquely indicating colors of the pixels. In this exemplary embodiment, as an example, it is assumed that color information for each pixel of an image is shown depending on the concentration of each of yellow (Y), magenta (M), cyan (C), and black (K), but other expression methods of uniquely showing colors of an image may be used.

The print head 50 includes four print heads 50Y, 50M, 50C, and 50K corresponding to four colors of a Y color, an M color, a C color, and a K color, respectively, and ejects ink drops of the corresponding color from the print head 50 of each color. Meanwhile, a driving method for ejecting ink drops in the print head 50 is not particularly limited, but a well-known method such as a so-called thermal method or piezoelectric method may he applied.

The laser driving unit 60 includes a switching element, such as a field effect transistor (FET), which controls turn-on and turn-off of a laser element included in the laser drying device 70, and drives the switching element on the basis of an instruction from the control unit 20.

The control unit 20 controls the laser driving unit 60 to irradiate an image formation surface of the continuous sheet P with a laser from the laser drying device 70 and to dry ink drops constituting an image formed on the continuous sheet P, thereby achieving the fixing of the image en the continuous sheet P. Meanwhile, a device including the laser driving unit 60 and the laser drying device 70 is referred to as a drying device.

In addition, a distance from the laser drying device 70 to the continuous sheet P is set on the basis of a radiation angle of the laser element and an extent of a radiation region.

Thereafter, the continuous sheet P is transported up to the discharge roll 90 in association with the rotation of the transport roller 100, and is wound around the discharge roll 90.

For example, the sheet speed detection sensor 110 is disposed at a position facing an image formation surface of the continuous sheet P, and detects a transport speed in the transport direction of the continuous sheet P. A detection method for detecting the transport speed of the continuous sheet P in the sheet speed detection sensor 110 is not particularly limited, but a well-known method may be applied. Meanwhile, the sheet speed detection sensor 110 is not essential for the ink jet recording device 10 according to this exemplary embodiment.

In addition, ink includes water-based ink, oil-based ink which is ink from which a solvent evaporates, UV curable ink, and the like, but it is assumed that water-based ink is used in this exemplary embodiment. Hereinafter, it is assumed that the simple description of "ink" or "ink drop" means "water-based ink" or "water-based ink drop", respectively.

As described above, in the ink jet recording device 10, when the ink drops ejected to the continuous sheet P are dried, the laser drying device 70 is used instead of a carbon heater which has been used hitherto.

In the drying of ink drops using a carbon heater, ink drops are dried by blowing warm air on the entirety of the image formation surface of the continuous sheet P. However, when ink drops are dried using the laser drying device 70, ink drops included in a laser irradiation region of the laser drying device 70 are dried. Accordingly, when the ink drops are dried by laser irradiation, it is necessary to examine how to set the laser irradiation region in the laser drying device 70.

Figure 2:
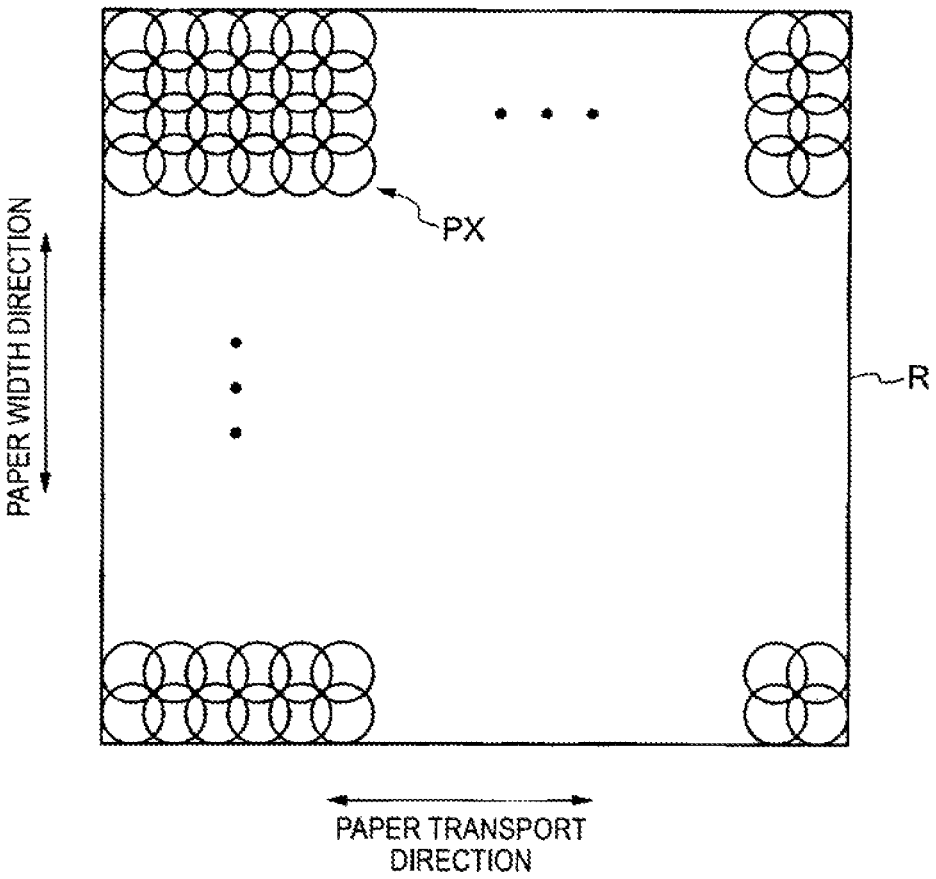
FIG. 2 is a schematic diagram showing a laser irradiation region of a laser element.

FIG. 2 is a diagram showing a laser irradiation region R of the laser element included in the laser drying device 70.

As shown in FIG. 2, in the laser drying device 70 according to this exemplary embodiment, the laser irradiation region R of the laser element is set so that plural ink drops PX are included in the laser irradiation region R of one laser element. For example, when a print resolution of the print bead 50 is 1200 dpi (dots per inch), a region including sixty ink drops PX in the sheet transport direction and sixty ink drops PX in the sheet width direction which is a direction perpendicular to the sheet transport direction is set as the laser irradiation region R. In this case, the laser irradiation region R is shown as a rectangular shape having lengths of 1.27 mm in the sheet transport direction and 1.27 mm in the sheet width direction.

The laser irradiation region R is set in this manner, and thus the number of laser elements required to dry ink drops is decreased, as compared with a case where the laser irradiation region R of the laser element is set so that one ink drop PX is included in the laser irradiation region R. In addition, since the number of switching elements driving the laser element is decreased in association with a decrease in the number of laser elements, a driving circuit of the laser element is simplified.

Accordingly, the laser driving unit 60 and the laser drying device 70 become smaller, as compared with a case where the laser irradiation region R of the laser element is set so that one ink drop PX is included in the laser irradiation region R. In addition, manufacturing costs of the laser driving unit 60 and the laser drying device 70 are reduced.

Meanwhile, in the laser drying device 70 according to this exemplary embodiment, the laser irradiation region R is set as a region including plural ink drops along the sheet transport direction and the sheet width direction, but a region setting method of the laser irradiation region R is not limited thereto.

For example, a region including plural ink drops along at least one of the sheet transport direction and the sheet width direction may be set to as the laser irradiation region R. In addition, the shape of the laser irradiation region R is not limited to a rectangular shape.

Next, the laser drying device 70 according to this exemplary embodiment will be described in detail.

Figure 3:
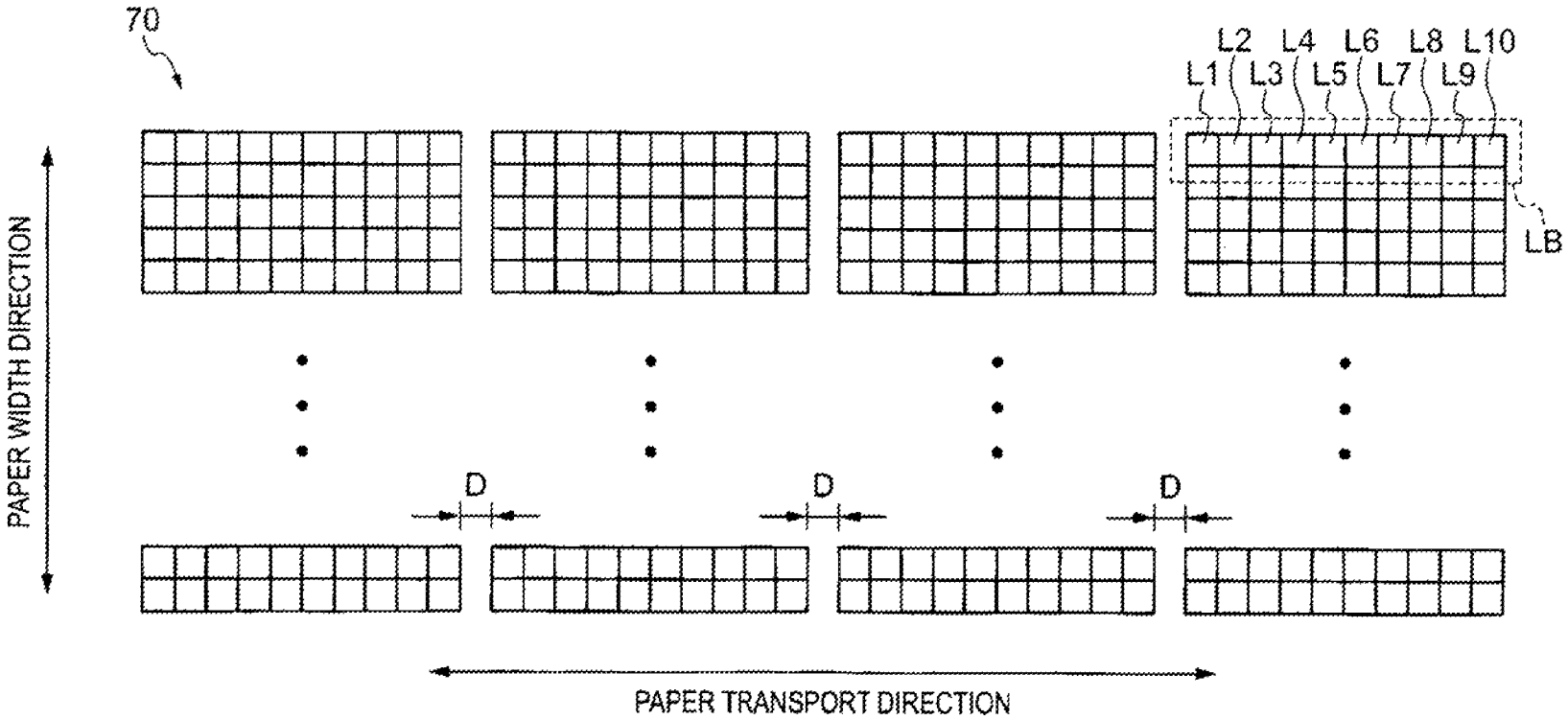
FIG. 3 is a schematic diagram showing a laser irradiation surface of a laser drying device.

FIG. 3 is a diagram showing a laser irradiation surface of the laser drying device 70. Here, the laser irradiation surface refers to an irradiation surface of a laser beam which is provided so as to face the image formation surface of the continuous sheet P.

As shown in FIG. 3, plural laser elements L having the laser irradiation region R are disposed on the laser irradiation surface of the laser drying device 70 alone the sheet transport direction and the sheet width direction. The plural laser elements L are collected as a laser element block LB for each number which is determined in advance, and are collectively driven for each laser element block LB by the laser driving unit 60. Meanwhile, the laser element block LB is an example or a laser element group.

In addition, the laser element blocks LB are disposed in the sheet width direction so that laser irradiation regions RB of the respective laser element blocks LB are adjacent to each other without a gap or overlap each other. At this time, the laser element blocks LB are disposed in the sheet width direction throughout an ejection limit position of ink drops in the sheet width direction which are ejected by the print head 50.

Here, the laser irradiation region RB of the laser element block LB serves as a region in which the laser irradiation regions R of the laser elements L included in the laser element block LB are combined with each other.

As shown in FIG. 3, when ten laser elements L1, . . . , L10 which are lined up in the sheet transport direction are set to one laser element block LB, a rectangular region having lengths of 1.27 mm in the sheet width direction and 12.7 mm in the sheet transport direction serves as the laser irradiation region RB.

On the other hand, in sheet transport direction, the laser element block LB is disposed at an interval D from another laser element block LB.

In this manner, methods of arranging the laser element block LB are different from each other in the sheet transport direction and the sheet width direction, and this is because of the following reasons.

In the sheet width direction, when the laser irradiation regions RB of the laser element blocks LB are not disposed so as to be adjacent to each other without a gap or to overlap each other, a region (non-irradiation region) which is not included in the laser irradiation regions RB of any of the laser element blocks LB is generated on the image formation surface of the continuous sheet P. Accordingly, uneven drying of ink drops occurs.

On the other hand, in the sheet transport direction, even when there is a gap between the laser irradiation regions RB, ink drops move in the sheet transport direction. Accordingly, when the laser irradiation regions RB are disposed without a gap in the sheet width direction, a non-irradiation region is not generated on the image formation surface of the continuous sheet P.

Therefore, in the sheet transport direction, as in the laser element blocks LB in the sheet width direction, it is not necessary to dispose the laser element blocks LB at positions where the laser irradiation regions RB corresponding to the laser element blocks LB are contiguous to each other without a gap.

In addition, as will be described later, the laser element blocks LB are disposed with the interval D interposed therebetween, and thus it is possible to secure a space where a wiring for connecting the laser element block LB to the laser driving unit 60 is disposed.

Meanwhile, as an example, in the laser drying device 70 shown in FIG. 3, ten laser elements L1, L2, . . . , L10 are set to one laser element block LB, but the number of laser elements L included in the laser element block LB is not limited. In addition, in the laser drying device 70 shown in FIG. 3, four columns of the laser element blocks LB are lined up in the sheet transport direction, but the number of columns of the laser element blocks LB is not particularly limited.

However, as the number of columns of the laser element blocks LB lined up in the sheet transport direction increases, a laser irradiation time for which the ink drops PX are irradiated is increased. Thus, it is possible to further reduce the laser irradiation intensity of the laser element block LB. This is because energy required to dry the ink drops is based on a product of the laser irradiation intensity and the laser irradiation time.

As the laser irradiation intensity of the laser element block LB further decreases, it is possible to suppress a phenomenon in which ink drops evaporate instantaneously during the laser irradiation of the ink drops. Accordingly, as the number of columns of the laser element blocks LB lined up along the sheet transport direction increases, an effect of suppressing the color unevenness of an image formed on the continuous sheet P is expected.

In this manner, the laser element block LB according to this exemplary embodiment includes the plural laser elements L, and the laser driving unit 60 collectively drives the laser elements L included in the laser element block LB. Accordingly, a circuit size required to drive the laser element L is decreased as compared with a case where the laser element L is driven for each laser element L, and thus manufacturing costs and the size of the apparatus are expected to be reduced.

Further, it is possible to more simplify the contents of a driving control by reducing the number of objects to be driven, and thus the reliability of the laser driving unit 60 is expected to be improved.

Next, an internal configuration of the laser element L according to this exemplary embodiment will be described.

Figure 4:
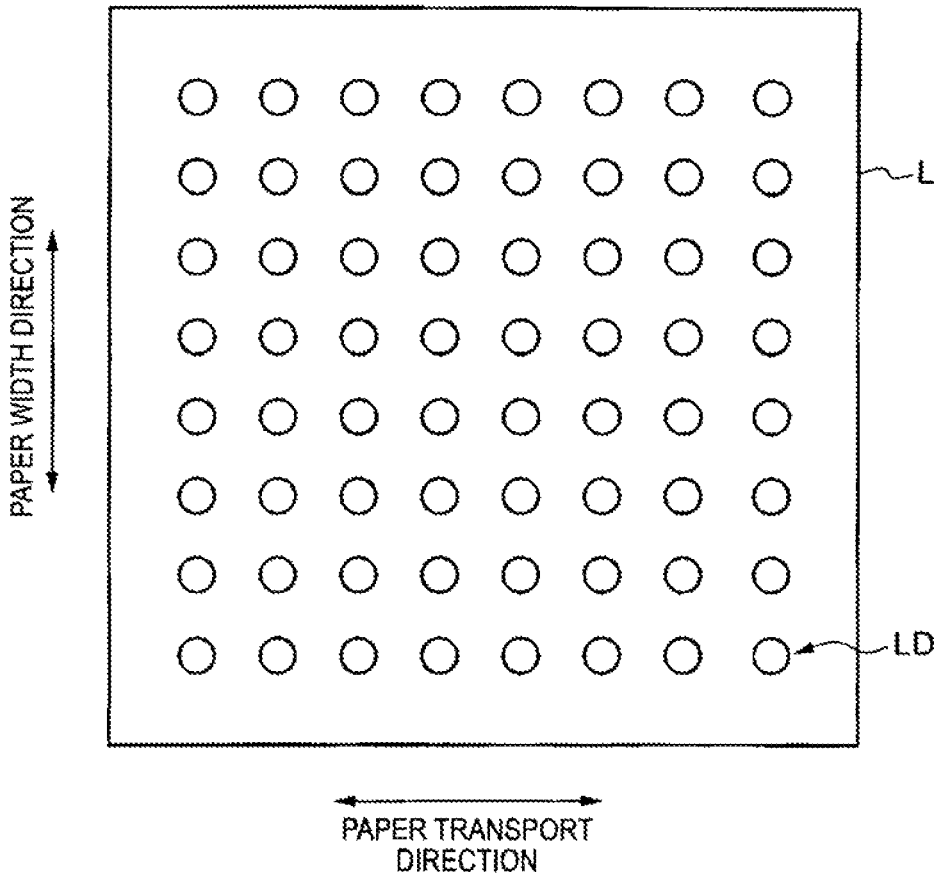
FIG. 4 is a schematic diagram showing a laser irradiation surface of a laser element.

FIG. 4 is a diagram showing the laser irradiation surface of the laser element L. As shown in FIG. 4, the laser element L according to this exemplary embodiment includes plural laser emission units LD such as, for example, a vertical cavity surface emitting laser (VCSEL). Here, as an example, a description will be given on the assumption that the laser element L includes a total of sixty-four laser emission units LD of eight columns in the sheet transport direction by eight columns in the sheet width direction, but the number of laser emission units is not limited thereto.

In the laser element L shown in FIG. 4, the plural laser emission units LD are disposed along the sheet transport direction and the sheet width direction, but the plural laser emission units LD may be arrayed along at least one of the sheet transport direction and the sheet width direction.

Figure 5:
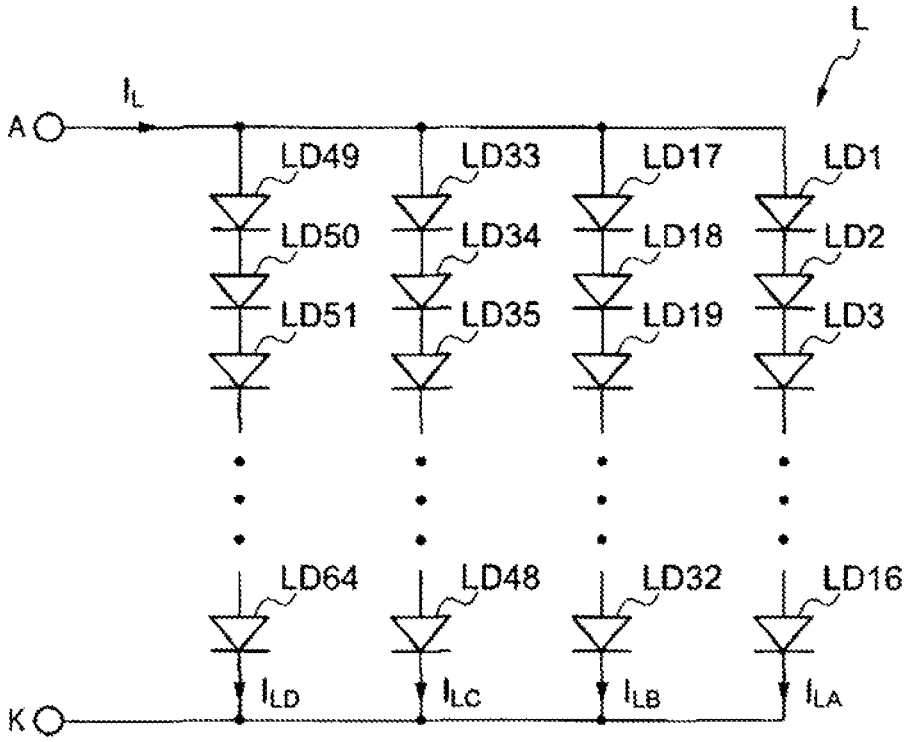
FIG. 5 is a connection diagram of a laser emission unit included in a laser element.

FIG. 5 is a diagram showing connection between the laser emission units LD in the laser element L.

For example, laser emission units LD1 to LD64 are divided into four laser emission unit groups each including sixteen laser emission units. Then, the laser emission units LD included in each laser emission unit group are connected to each other in series, and the laser emission unit groups are connected to each other in parallel. One connection point of the laser emission unit groups connected to each other in parallel serves as an anode (A) terminal of the laser element L, and the other connection point serves as a cathode (K) terminal of the laser element L.

In this case, when a rated voltage for driving one laser emission unit LD is set to 1.9 V and current values $I_{LA}$, $I_{LB}$, $I_{LC}$, and $I_{LD}$ flowing through the respective laser emission unit groups are set to 17.5 mA, a driving rated value of the laser element L is set to 30.4 V and 70 mA.

Figure 6:
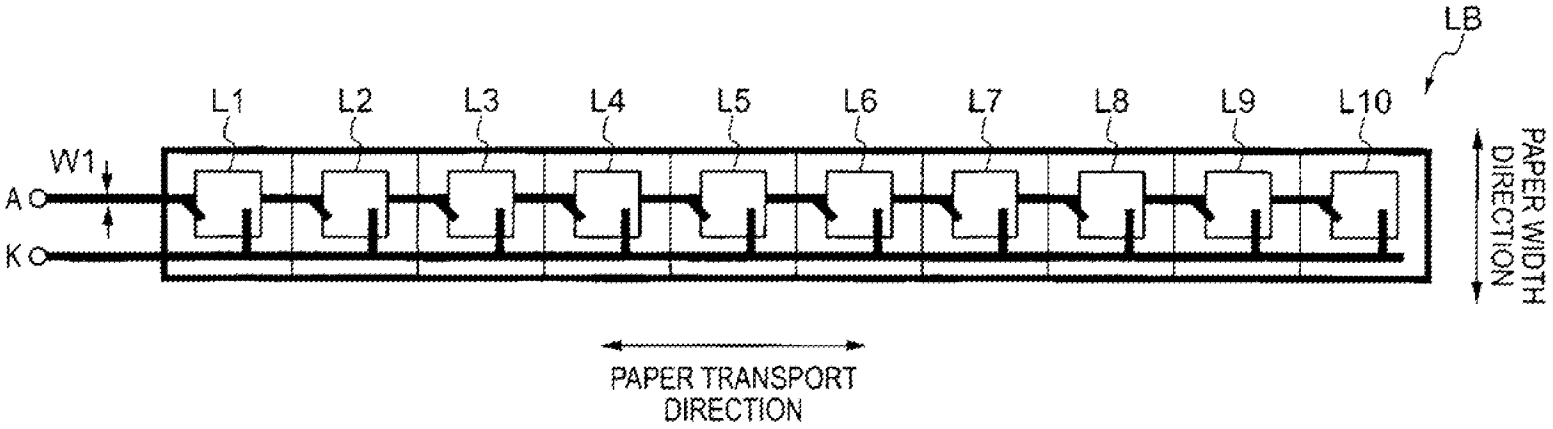
FIG. 6 is a diagram showing an example of a wiring in a laser element block.

Further, FIG. 6 is a diagram showing an example of a wiring in one laser element block LB. The laser element block LB is disposed on a substrate not shown in the drawing, and a wiring provided with the terminal A and the terminal K which connect the laser element block LB and the laser driving unit 60 is disposed on the substrate.

At this lime, as shown in FIG. 6, the terminal A and the terminal K of the laser element block LB are provided at a position along the sheet transport direction in the laser drying device 70. An anode wiring that connects the terminal A of the laser element block LB to the respective terminals A of the laser elements L1 to L10 is disposed so as to pass through the back faces of the laser elements L1 to L10 along the sheet transport direction.

On the other hand, a cathode wiring that connects the terminal K of the laser element block LB and the respective terminals K of the laser elements L1 to L10 is disposed so as to avoid the back faces of the laser elements L1 to L10 along the sheet transport direction.

In this manner, the terminal A and the terminal K of the laser element block LB according to this exemplary embodiment are collectively provided at one end along the sheet transport direction of the laser element block LB. Accordingly, as shown in FIG. 3, a space between the laser element blocks LB provided in the sheet transport direction of the laser drying device 70 can be used as a space through which a wiring connecting the laser element block LB to the laser driving unit 60 passes.

Figure 7:
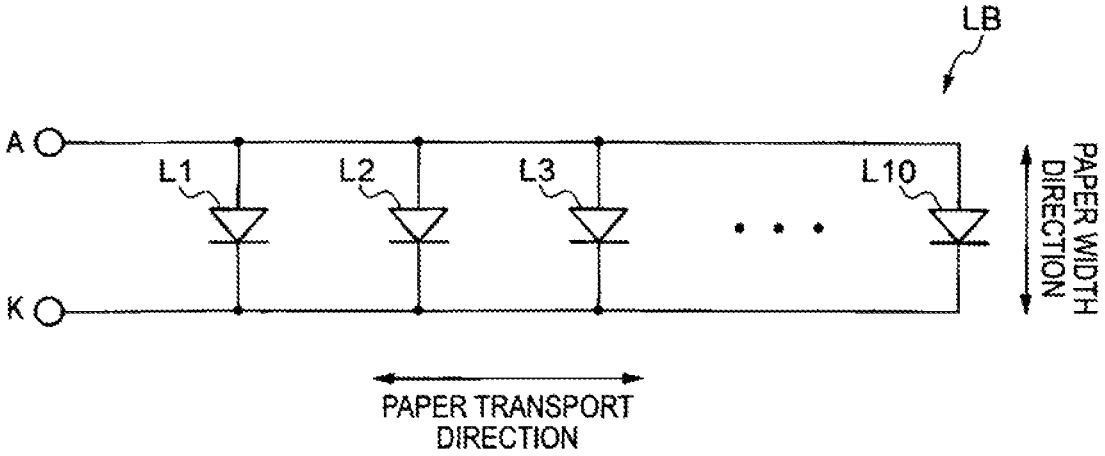
FIG. 7 is a connection diagram of a laser element in the laser element block corresponding to FIG. 6.

FIG. 7 is a diagram showing connection between the laser elements L1 to L10 in the laser element block LB.

In this case, as shown in FIG. 7, the laser elements L1 to L10 included in the laser element block LB are connected to each other in parallel. Accordingly, a driving rated value of the laser element block LB is set to 30.4 V and 700 mA.

Figure 8:
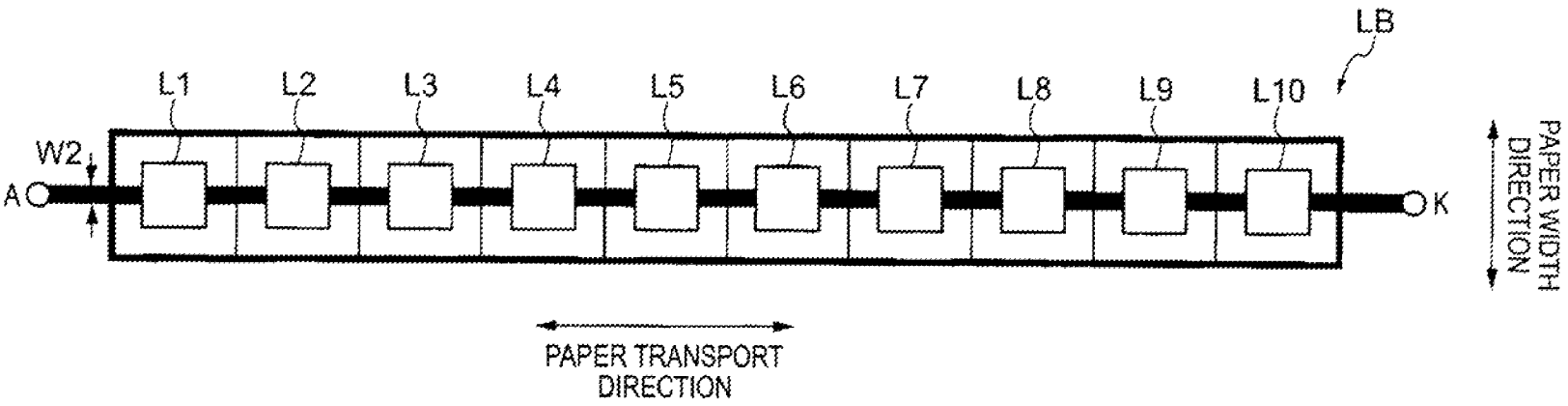
FIG. 8 is a diagram showing an example of a wiring in a laser element block.

Meanwhile, the terminal A and the terminal K of the laser element block LB are not limited to the positions shown in FIG. 6. For example, as shown in FIG. 8, the respective laser elements L1 to L10 may be connected to each other in series by a wiring provided along the sheet transport direction, and any one of the terminal A and the terminal K of the laser element block LB may be provided on each side of the laser element block LB along the sheet transport direction.

Figure 9:
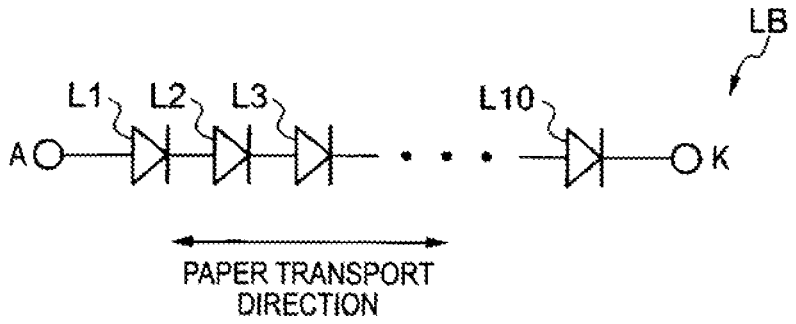
FIG. 9 is a connection diagram of a laser element in the laser element block corresponding to FIG. 8.

FIG. 9 is a diagram showing connection between the laser elements L1 to L10 in the laser element block LB at this time.

However, when the laser element L having the connection shown in FIG. 5 is applied to the laser elements L1 to L10 of the laser element block LB shown in FIG. 9, a rated voltage of the laser element L is 30.4 V, and thus a rated voltage of the laser element block LB is set to 304 V. Accordingly, in a general-purpose FET which is generally available in the market and has a relatively low price, it is difficult to drive the laser element block LB. Accordingly, it is actually difficult to simply connect the laser elements L, having the connection shown in FIG. 5, to each other in series.

Figure 10:
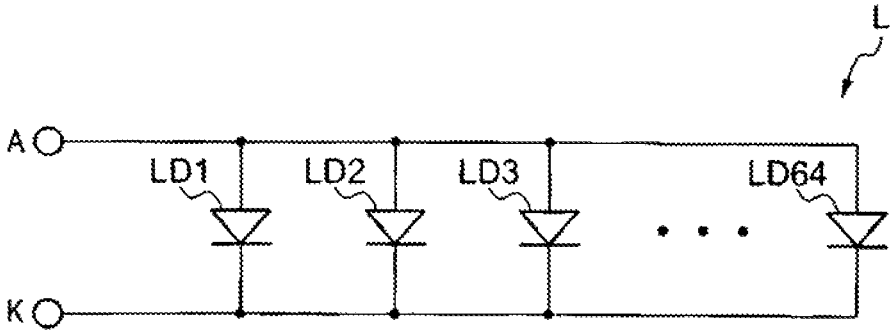
FIG. 10 is a connection diagram of a laser emission unit included in the laser element corresponding to FIG. 9.

Accordingly, when the laser element block LB is configured by connecting the laser elements L to each other in series, the laser element L having the connection between the laser emission units LD shown in FIG. 10 is used.

In the laser element L shown in FIG. 10, sixty-four laser emission units LD1 to LD64 are connected to each other in parallel. A rated voltage for driving one laser emission unit LD is 1.9 V. At this time, when a current flowing through the laser emission unit LD is set to 21.875 mA, a driving rated value of the laser element L in FIG. 10 is set to 1.9 V and 1400 mA. Accordingly, a driving rated value of the laser element block LB in FIG. 9 is set to 19 V and 1400 mA, which are driving rated values in a range that can be handled in the general-purpose FET.

Meanwhile, it is known that widths W1 and W2 of the wiring of the laser element block LB in FIGS. 6 and 8 depend on the magnitude of a current flowing through the wiring. Specifically, as the magnitude of the current flowing through the wiring increases, the width of the wiring is required to be enlarged.

Here, a driving current of the laser element block LB shown in FIG. 6 is 700 mA, and a driving current of the laser element block LB shown in FIG. 8 is 1400 mA. That is, it is possible to make the width W1 of the wiring of the laser element black LB shown in FIG. 6 narrower than the width W2 of the wiring of the laser element block LB shown in FIG. 8. Accordingly, since the number of wirings per unit area can be increased, it is possible to adopt a small component having a relatively small interval between terminals, for example, in selecting a component such as a connector connected to the wiring.

Up to here, although the configuration of the laser drying device 70 has been described, a method of driving the laser drying device 70 will be described below.

As described above, the laser driving unit 60 according to this exemplary embodiment controls turn-on and turn-off of the laser element block LB for each laser element block LB. Accordingly, as compared with a case where all the laser element blocks LB included in the laser drying device 70 are collectively turned on or turned off, an effect of suppressing unnecessary laser irradiation of a region having no ink drop is expected. Therefore, energy consumption required when drying ink drops is suppressed, and thus the ink drops are efficiently dried.

Further, the laser driving unit 60 according to this exemplary embodiment calculates in advance a front face printing rate of an image included in the laser irradiation region R for each laser irradiation region R corresponding to each of the laser elements L included in the laser drying device 70, on the basis of image information.

Here, the printing rate refers to a rate of the number of locations at which ink drops are actually dropped with respect to the total number of locations at which ink drops can be dropped, in a region of the continuous sheet P which is determined in advance. In this case, the region determined in advance is set to the laser irradiation region R. In addition, specifically, the front face printing rate of the image included in the laser irradiation region R refers to a printing rate of the continuous sheet P on a laser irradiation surface (front face) included in the laser irradiation region R corresponding to each of the laser elements L when the image is formed on the continuous sheet P.

When all the front face printing rates of the images included in the respective laser irradiation regions R of the laser elements L included in the laser element block LB are 0%, the laser driving unit 60 drives the corresponding laser element block LB so as not to emit a laser from the laser element block LB.

On the other hand, when the front face printing rates of the images included in at least one or more laser irradiation regions R among the laser irradiation regions R of the respective laser elements L included in the laser element block LB are greater than 0%, the laser driving unit 60 turns on the corresponding laser element block LB.

In addition, as described above, the laser driving unit 60 calculates a timing when each of the laser element blocks LB is turned on or turned off, on the basis of the transport speed of the continuous sheet P.

Specifically, the laser driving unit 60 turns on or turns off the laser element block LB in accordance with the front face printing rate of the image included in the laser irradiation region R, for each time required for the continuous sheet P to pass through the laser irradiation region R in the sheet transport direction (switching time).

In this manner, the laser driving unit 60 drives the laser element blocks LB. Accordingly, when ink drops are present within the laser irradiation region RB corresponding to the laser element block LB, a laser is emitted from the laser drying device 70.

Therefore, regardless of whether ink drops are present within the laser irradiation region RB, an effect of suppressing energy consumption required when drying ink drops is expected, as compared with a case where a laser is continuously emitted from the laser element block LB during the formation of an image.

Next, main electrical components in the ink jet recording device 10 will be described with reference to FIG. 11. The control unit 20 can be realized by, for example, a computer 20.

Figure 11:
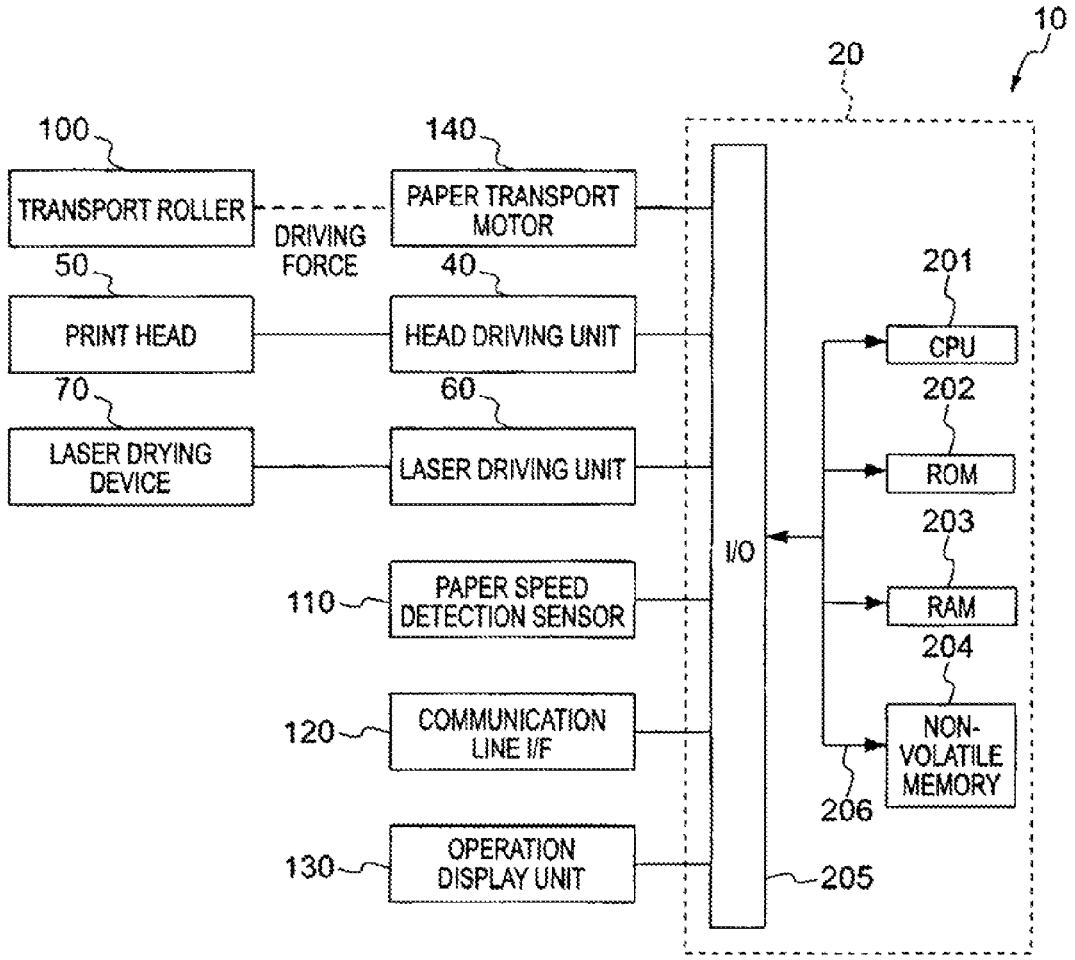
FIG. 11 is a block diagram showing main electrical components of the ink jet recording device according to the first embodiment and the second embodiment.

As shown in FIG. 11, in the computer 20, a central processing unit (CPU) 201, a read only memory (ROM) 202, a random access memory (RAM) 203, a non-volatile memory 204, and an input-output interface (I/O) 205 are connected to each other through a bus 206. The head driving unit 40, the laser driving unit 60, the sheet speed detection sensor 110, the communication line I/F (Interface) 120, the operation display unit 130, and the sheet transport motor 140 are connected to the I/O 205. Further, the print head 50 is connected to the head driving unit 40, and the laser drying device 70 is connected to the laser driving unit 60. In addition, the transport roller 100 is connected to the sheet transport motor 140 through a driving mechanism such as, for example, a gear, and the transport roller 100 is rotated in association with the driving of the sheet transport motor 140.

The computer 20 executes a program, which is installed in advance in the ROM 202, by the CPU 201, and performs data communication with the members connected to the I/O 205 in accordance with the program, thereby controlling the ink jet recording device 10.

The head driving unit 40 includes a switching element such as, for example, a FET which turns on or turns off the print head 50, and drives the switching element by receiving an instruction from the computer 20.

The print head 50 includes, for example, a piezoelectric element that converts a change in voltage to a force, and the like, operates the piezoelectric element and the like in response to a driving instruction from the head driving unit 40, and ejects ink drops supplied from an ink tank, not shown in the drawing, toward the continuous sheet P from a nozzle ejection port.

For example, the laser driving unit 60 includes a switching element, such as a FET, which turns on or turns off the laser element block LB for each laser element block LB included in the laser drying device 70, and drives the switching element by receiving an instruction from the computer 20.

For example, the laser drying device 70 includes the laser element block LB, and emits a laser toward the continuous sheet P from the laser element block LB in response to a driving instruction from the laser driving unit 60.

The communication line I/F 120 is an interface which is connected to a communication line not shown in the drawing and which is for performing data communication with a terminal device such as a personal computer, not shown in the drawing, which is connected to the communication line. The communication line not shown in the drawing may be any of a wired line and a wireless line, and may be configured to receive image information together with a request for forming an image from, for example, a terminal device not shown in the drawing.

The operation display unit 130 receives an instruction from a user of the ink jet recording device 10 and notifies the user of various pieces of information on operation situations and the like of the ink jet recording device 10. For example, the operation display unit 130 includes a display button that realizes the reception of an operation instruction by a program, a touch panel type display on which various pieces of information are displayed, a hardware key such as a numerical keypad or a start button, and the like.

The process of the ink jet recording device 10 configured in the above-described manner can be realized by a software configuration using the computer 20 by executing a program.

Hereinafter, operations of the ink jet recording device 10 according to this exemplary embodiment will be described in detail.

Figure 12:
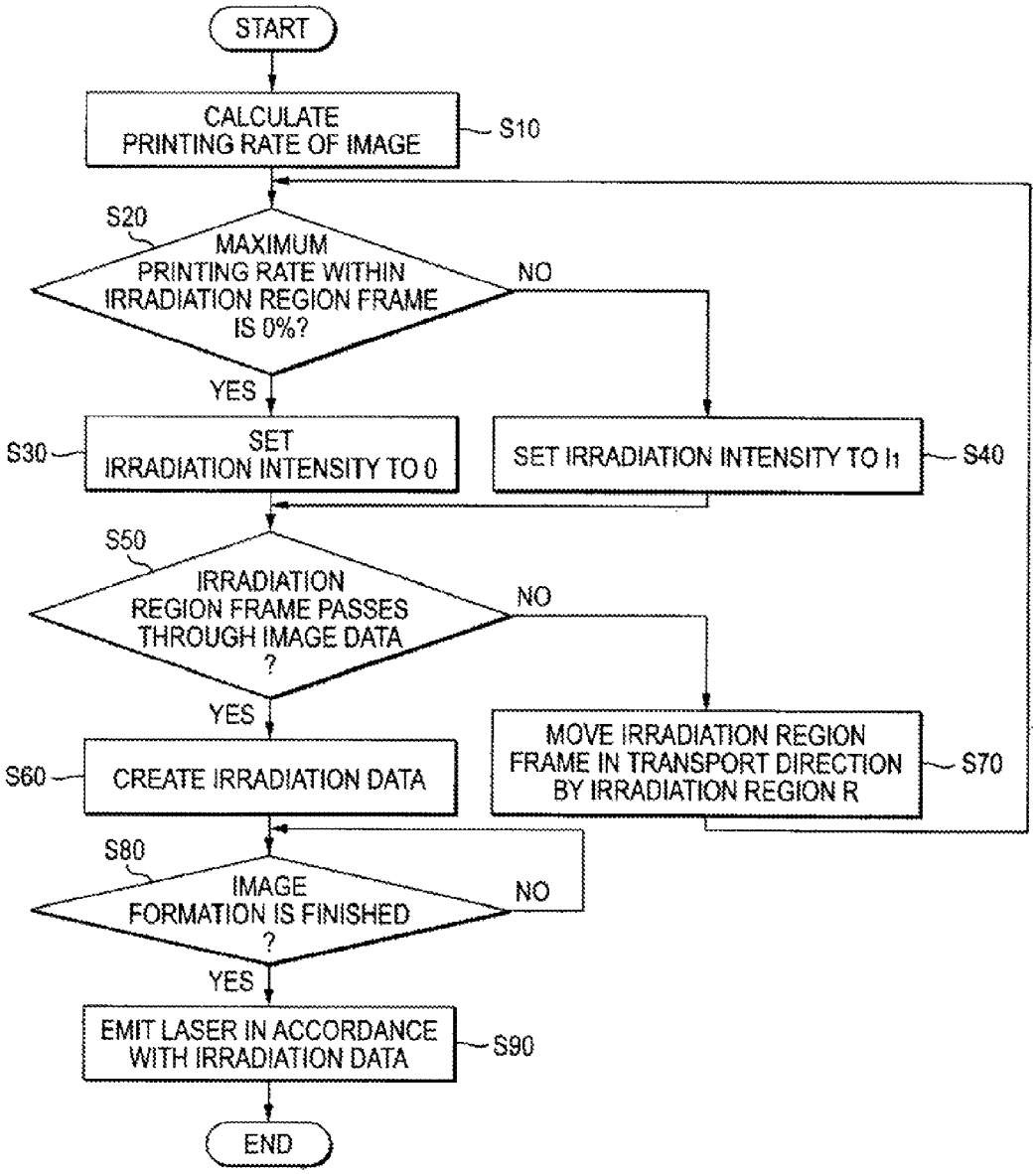
FIG. 12 is a flow chart of a drying program according to the first embodiment.

FIG. 12 is a flow chart showing a flow of processing of a drying program executed by the CPU 201 of the computer 20, for example, when a request for forming an image is received from a user.

Meanwhile, the drying program is not limited to a configuration in which the program is installed in advance in the ROM 202 and is provided, and a configuration may be adopted in which the program is provided in a state where the program is stored in a computer-readable recording medium such as a CD-ROM or a memory card. In addition, a configuration may be adopted in which the program is distributed in a wired or wireless manner through the communication line I/F 120, or the like.

First, in step S10, for example, image information stored in advance in a region of the RAM 203 which is determined in advance is acquired. Next, the image information is developed in the region of the RAM 203 which is determined in advance so that colors and arrangement of pixels of an image which are shown by the image information conform to the position of the image formed on the continuous sheet P. Meanwhile, in this manner, the image information developed in the RAM 203 is referred to as image data.

The image data developed in the RAM 203 is divided into the size of the laser irradiation region R corresponding to the laser element L used in the laser drying device 70.

Figure 13:
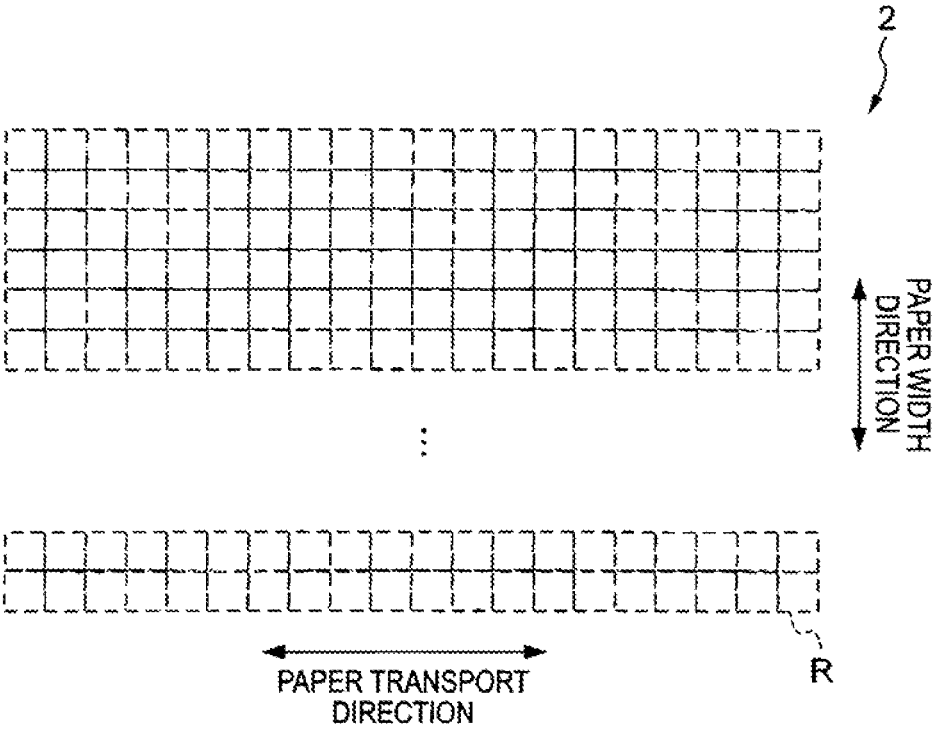
FIG. 13 is a schematic diagram illustrating the partitioning of image data.

FIG. 13 is a diagram showing an example when image data 2 is divided into the size of the laser irradiation region R.

Further, in step S10, a front face printing rate of the image data 2 is calculated for each laser irradiation region R and is then stored in the RAM 203 in association with each of the laser irradiation regions R.

In step S20, an irradiation region frame having the same size as the laser irradiation region RB corresponding to the laser element block LB used in the laser drying device 70 is virtually disposed on the image data 2 which is developed in the RAM 203 in the process of step S10.

Figure 14:
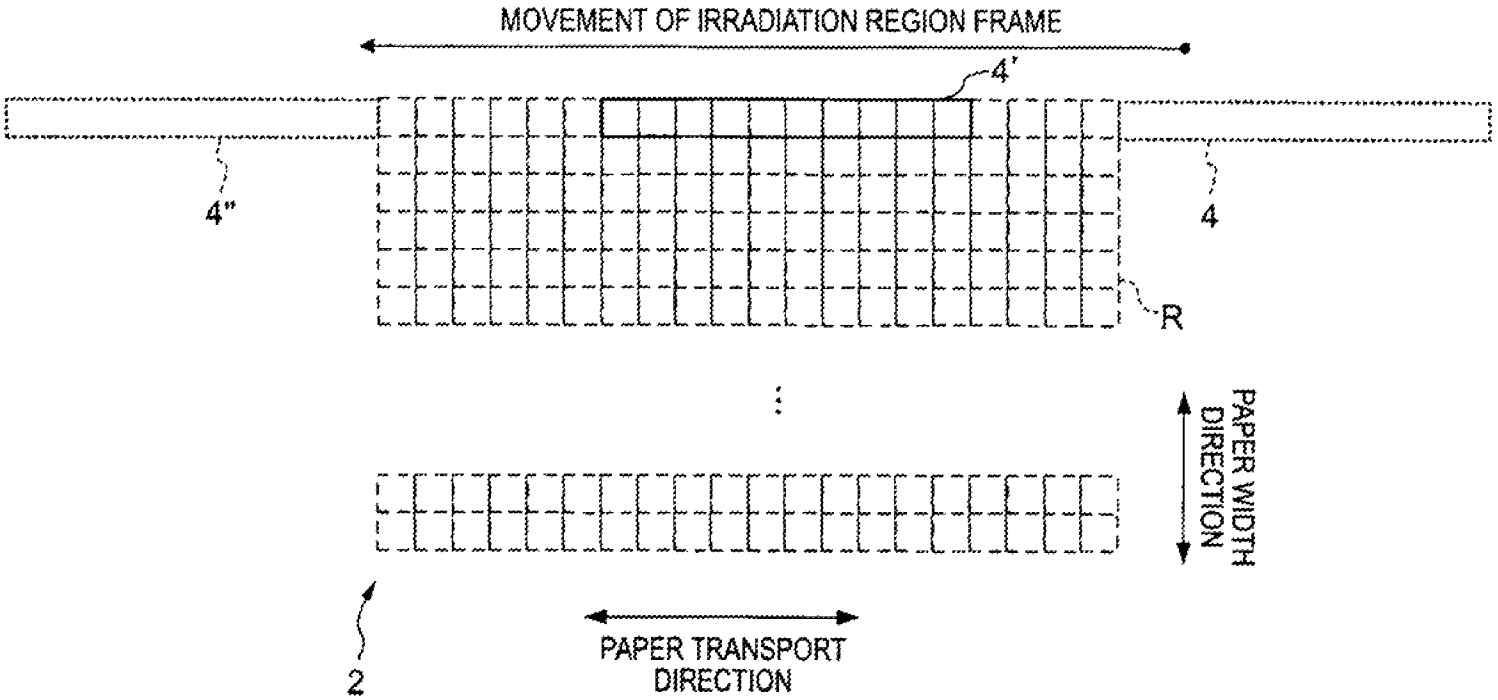
FIG. 14 is a schematic diagram illustrating an arrangement relationship between image data and an irradiation region frame.

FIG. 14 is a diagram showing an example when an irradiation region frame 4 is disposed on the image data 2. Meanwhile, in FIG. 14, although only one irradiation region frame 4 is shown for the purpose of simplifying the description, the same number of irradiation region frames 4 as the number of laser irradiation regions RB corresponding to the laser element block LB included in a real laser drying device 70 are disposed at the same positions as those of the respective laser irradiation regions RB.

First, for example, the irradiation region frame 4 is virtually disposed at a position where the laser irradiation region R of the image data 2 is not included in the irradiation region frame 4. This corresponds to a state where a positional relationship between the image and the laser irradiation region RB is virtually realized on the RAM 203 before the image formed on the continuous sheet P is transported to the laser irradiation region RB corresponding to the laser element block LB.

Next, it is determined for each irradiation region frame 4 whether the laser irradiation region R having a front face printing rate of greater than 0% is present within the irradiation region frame 4, that is, whether a maximum front face printing rate within the irradiation region frame 4 is 0%, with reference to the front face printing rate of the laser irradiation region R included in the irradiation region frame 4. In a case of an affirmative determination, the processing proceeds to step S30. On the other hand, in a case of a negative determination, the processing proceeds to step S40.

In step S30 and step S40, the irradiation intensity is set of a laser emitted from the laser element block LB when the positional relationship between the laser element block LB and the image formed on the continuous sheet P becomes a positional relationship between the irradiation region frame 4 and the image data 2.

First, in step S30, since the maximum front face printing rate within the irradiation region frame 4 is 0%, that is, a state where ink drops are not present within the irradiation region frame 4 is set, a laser irradiation intensity is set to 0 W/cm$^2$.

Positional information of the image with respect to the laser irradiation region RB of the laser element block LB based on the positional relationship between the irradiation region frame 4 and the image data 2 is stored in, for example, the region of the RAM 203 which is determined in advance, in association with the set irradiation intensity.

On the other hand, in step S40, since a state where the maximum front face printing rate within the irradiation region frame 4 is greater than 0%, that is, a state where ink drop are present within the irradiation region frame 4 is set, a laser irradiation intensity is set to $I_1$ W/cm$^2$. As an example, it is assumed that the irradiation intensity $I_1$ is a maximum irradiation intensity of the laser element block LB and the value of the irradiation intensity $I_1$ is stored in advance in, for example, a region of the non-volatile memory 204 which is determined in advance.

Meanwhile, in the above description, the description has been given on the assumption that the irradiation intensity of a laser emitted from the laser element block LB is set to a maximum value when ink drops are present within the irradiation region frame 4, but the value of the irradiation intensity is not limited thereto. In this case, the irradiation intensity may be set to any value in a laser irradiation intensity range included in the laser element block LB.

The positional information of the image with respect to the laser irradiation region RB of the laser element block LB based on the positional relationship between the irradiation region frame 4 and the image data 2 is stored in, for example, the region of the RAM 203 which is determined in advance, in association with the set irradiation intensity.

In step S50, it is determined whether the irradiation region frame 4 is moved up to a position where the frame passes through the image data 2 in the sheet transport direction. That is, in FIG. 14, it is determined whether the irradiation region frame 4 is located at a position of an irradiation region frame 4". In a case of a negative determination, the processing proceeds to step S70.

At the time of proceeding to step S70, the laser irradiation intensity of the laser element block LB in each positional relationship between the irradiation region frame 4 and the image data 2 which is allowable until the irradiation region frame 4 passes through the image data 2 is not yet set.

Accordingly, in step S70, the irradiation region frame 4 is moved in a direction, which conforms with a change in a real positional relationship between the continuous sheet P and the laser element block LB, which changes by the continuous sheet P being transported, in the sheet transport direction. Meanwhile, the amount of movement of the irradiation region frame 4 at this time is set to a length of the laser irradiation region R in the sheet transport direction.

Then, the processing proceeds to step S20, and the processes of step S20 to step S50 are repeated. As a result of this process, as shown in FIG. 14, the irradiation region frame 4 is moved up to, for example, the position of an irradiation region frame 4' along the sheet transport direction, and is finally moved up to the position of the irradiation region frame 4" which passes through the image data 2. Accordingly, a laser irradiation intensity is set of the laser element block LB in each positional relationship between the irradiation region frame 4 and the image data 2 which is capable of being taken until the irradiation region frame 4 passes through the image data 2.

On the other hand, when an affirmative determination is made in the process of step S50, the processing proceeds to step S60.

In step S60, irradiation data indicating an irradiation intensity and an irradiation timing of a laser is created for each laser element block LB.

In each positional relationship between the laser irradiation region RB of the laser element block LB and the image formed on the continuous sheet P, the irradiation intensity of the laser emitted from the laser element block LB is set in the processes of step S30 and step S40.

Accordingly, in step S60, the image is formed on the continuous sheet P, a time required until the image reaches each positional relationship between the laser irradiation region RB and the image by the transport of the continuous sheet P (image transport time) is calculated on the basis of an image transport distance and a transport speed of the continuous sheet P.

Here, the image transport distance refers to a distance which is determined in advance for each laser element L included in the laser element block LB, and refers to a distance along the sheet transport direction from an image formation point to each laser element L. For example, it is assumed that the image transport distance is stored in advance in a region of the non-volatile memory 204 which is determined in advance.

In addition, the image formation point refers to a point where an image corresponding to image information is formed on the continuous sheet P. For example, in a case of the ink jet recording device 10 according to this exemplary embodiment, the image formation point is set to an ink drop ejection point of the print head 50K, which finally ejects ink, among the print heads 50. Meanwhile, the setting of the image formation point is not limited thereto. For example, the image formation point may be set to an ink drop ejection point of the print head 50C, which first ejects ink, among the print heads 50.

In addition, irradiation data is generated for each laser element block LB on the basis of the image transport time and the laser irradiation intensity of the laser element block LB in the positional relationship between the laser irradiation region RB and the image which corresponds to the image transport time. The generated irradiation data is stored in, for example, a region of the RAM 203 which is determined in advance.

Figure 15:
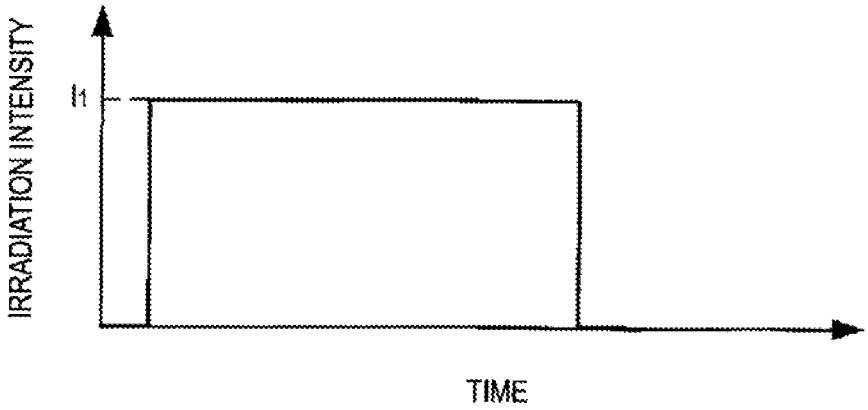
FIG. 15 is a diagram showing an example of irradiation data.

FIG. 15 is a diagram showing an example when the irradiation data generated in this step is shown graphically. As shown in FIG. 15, the irradiation data is data showing changes in laser irradiation intensity after ink drops are ejected onto the image formation point.

In step S80, for example, it is determined whether the formation of an image corresponding to image information on the continuous sheet P is completed. In a case of a negative determination, the process of step S80 is repeated until the formation of the image is completed. On the other hand, in a case of an affirmative determination, the processing proceeds to step S90.

In step S90, first, the irradiation data for each laser element block LB which is generated in step S60 is read out from the region of the RAM 203 which is determined in advance. A switching element that drives the laser element block LB at a timing determined by the irradiation data is controlled for each laser element block LB so that a laser having an irradiation intensity determined by the irradiation data is emitted from the laser element block LB. As described above, this program is terminated.

Figure 16:
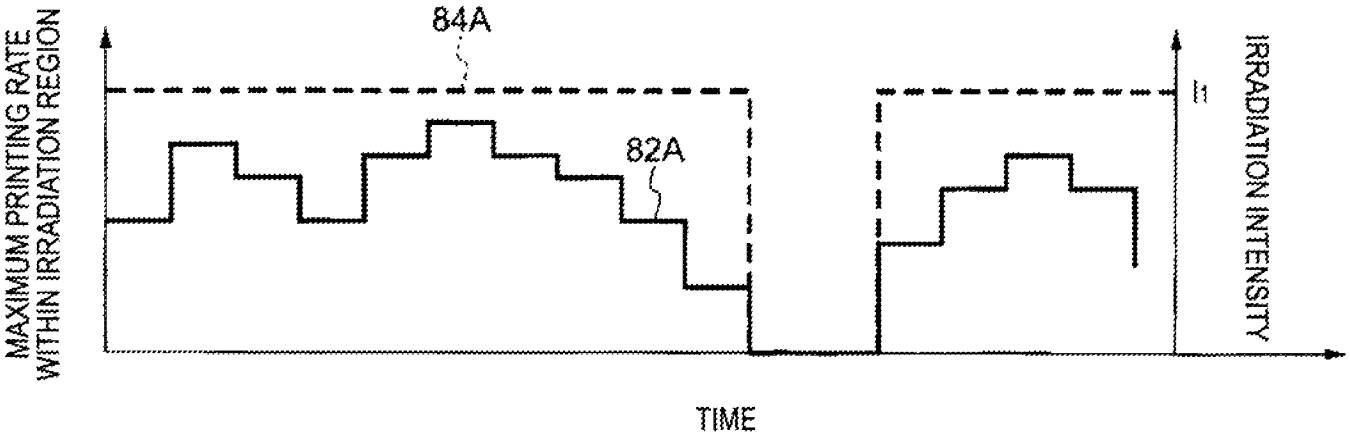
FIG. 16 is a graph showing irradiation intensity of a laser emitted from a laser element block according to the first embodiment.

FIG. 16 is a graph showing an example of changes in laser irradiation intensity in the laser element block LB when the laser drying device 70 is driven on the basis of the drying program shown in FIG. 12.

A graph 82A of FIG. 16 is a graph showing an example of a maximum front thee printing rate of the laser element L on the laser irradiation region R included in the laser element block LB (hereinafter, referred to as a maximum front face printing rate within the laser irradiation region RB). In addition, a graph 84A is a graph showing an example of the irradiation intensity of a laser emitted from the laser element block LB.

As shown in FIG. 16, when the maximum front face printing rate within the laser irradiation region RB is greater than 0%, the irradiation intensity of the laser element block LB is set to a maximum irradiation intensity $I_1$ W/cm$^2$ of the laser element block LB. In addition, when the maximum front face printing rate within the laser irradiation region RB is 0%, the irradiation intensity of the laser element block LB is set to 0 W/cm$^2$.

Meanwhile, the maximum front face printing rate changes at a time interval which is determined in advance. This is because the amount of movement of the irradiation region frame 4 is set to a length of the laser irradiation region R in the sheet transport direction in the process of step S70 of FIG. 12. That is, the time interval determined in advance is equivalent to a time required for ink drops to move by a length of the laser irradiation region R in the sheet transport direction.

In this manner, according to this exemplary embodiment, the front face printing rate of the image included in the laser irradiation region RB is calculated for each laser element block LB at a time interval determined in advance, and the irradiation intensity of a laser emitted from each laser element block LB is determined on the basis of the calculated front face printing rate. Specifically, when the maximum front face printing rate within the laser irradiation region RB is greater than 0%, the irradiation intensity is set to the maximum irradiation intensity $I_1$ W/cm$^2$ of the laser element block LB. When the maximum front face printing rate is 0%, the irradiation intensity is set to 0 W/cm$^2$. The switching element that drives the laser element block LB is controlled in accordance with the irradiation data generated for each laser element block LB.

Accordingly, when there is no ink drop within the laser irradiation region RB corresponding to the laser element block LB, the laser irradiation from the laser element block LB is stopped. Therefore, regardless of whether ink drops are present within the laser irradiation region RB, an effect of suppressing energy consumption required when drying ink drops is expected, as compared with a case where a laser is continuously emitted from the laser element block LB during the formation of an image.

Meanwhile, in the laser drying device 70 according to this exemplary embodiment, the laser emitted from the laser element block LB is stopped when a maximum front face printing rate within the laser irradiation region RB is 0%, but the value of the maximum front face printing rate for stopping the laser is not limited thereto.

For example, when the maximum front face printing rate within the laser irradiation region RB is less than a front face printing rate requiring laser irradiation, the laser emitted from the laser element block LB may be stopped. Meanwhile, the front face printing rate requiring laser irradiation may be determined in advance by an experiment using a real machine of the ink jet recording device 10, a computer simulation based on design specifications of the ink jet recording device 10, or the like, and may be stored in advance in the region of the non-volatile memory 204 which is determined in advance.

Meanwhile, in the laser drying device 70 according to this exemplary embodiment, a description is given on the assumption that the wiring shown in FIG. 6 is used as an example of a wiring of the laser element block LB, but the wiring in the laser element block LB is not limited thereto.

Figure 17:
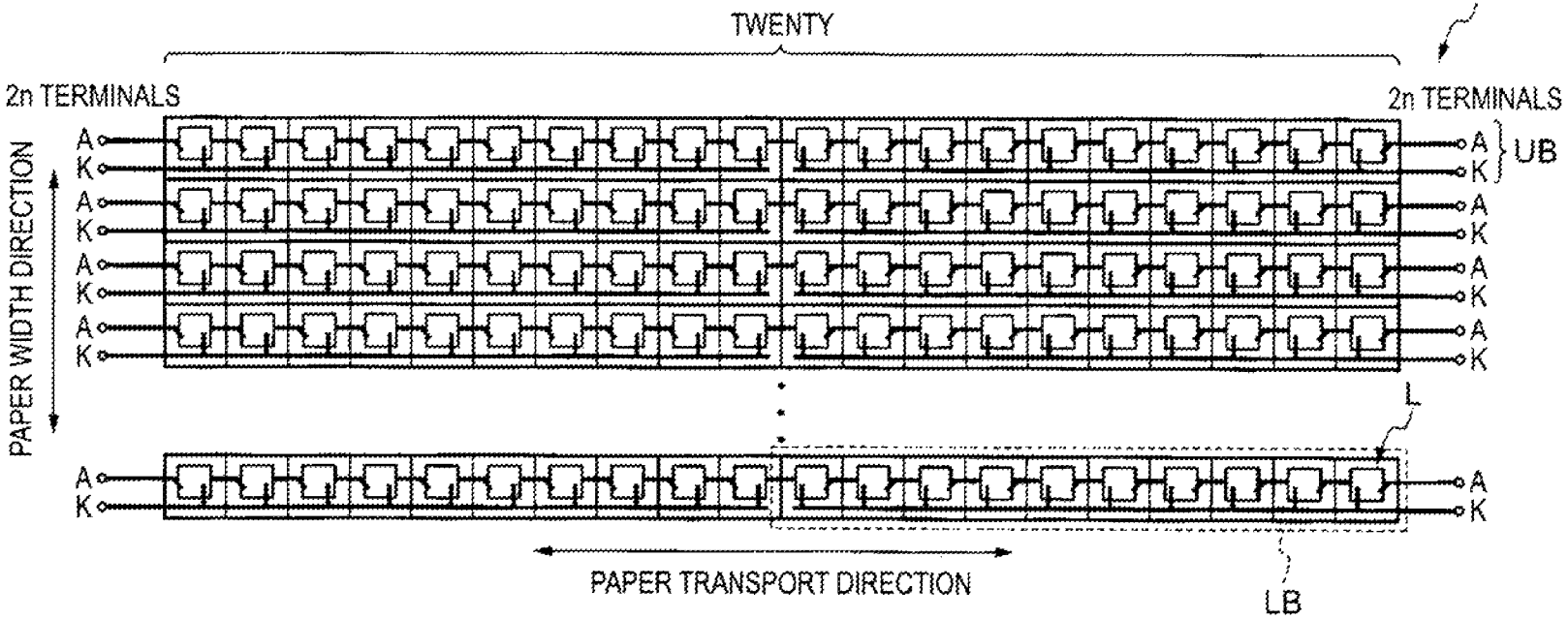
FIG. 17 is a diagram showing an example of a wiring in a laser element block.

FIG. 17 is a diagram showing an example of another wiring of the laser element block LB in the laser drying device 70.

In the laser drying device 70 shown in FIG. 17, the two laser element blocks LB (unit block UB), shown in FIG. 6, which are disposed lined up in the sheet transport direction, are further disposed lined up in the sheet width direction by the number of n. At this time, the terminal A and the terminal K of the unit block US are disposed along the sheet transport direction. That is, a total of two terminals of one terminal A and one terminal K are disposed at each of both ends of the unit block UB in the sheet transport direction.

Figure 18:
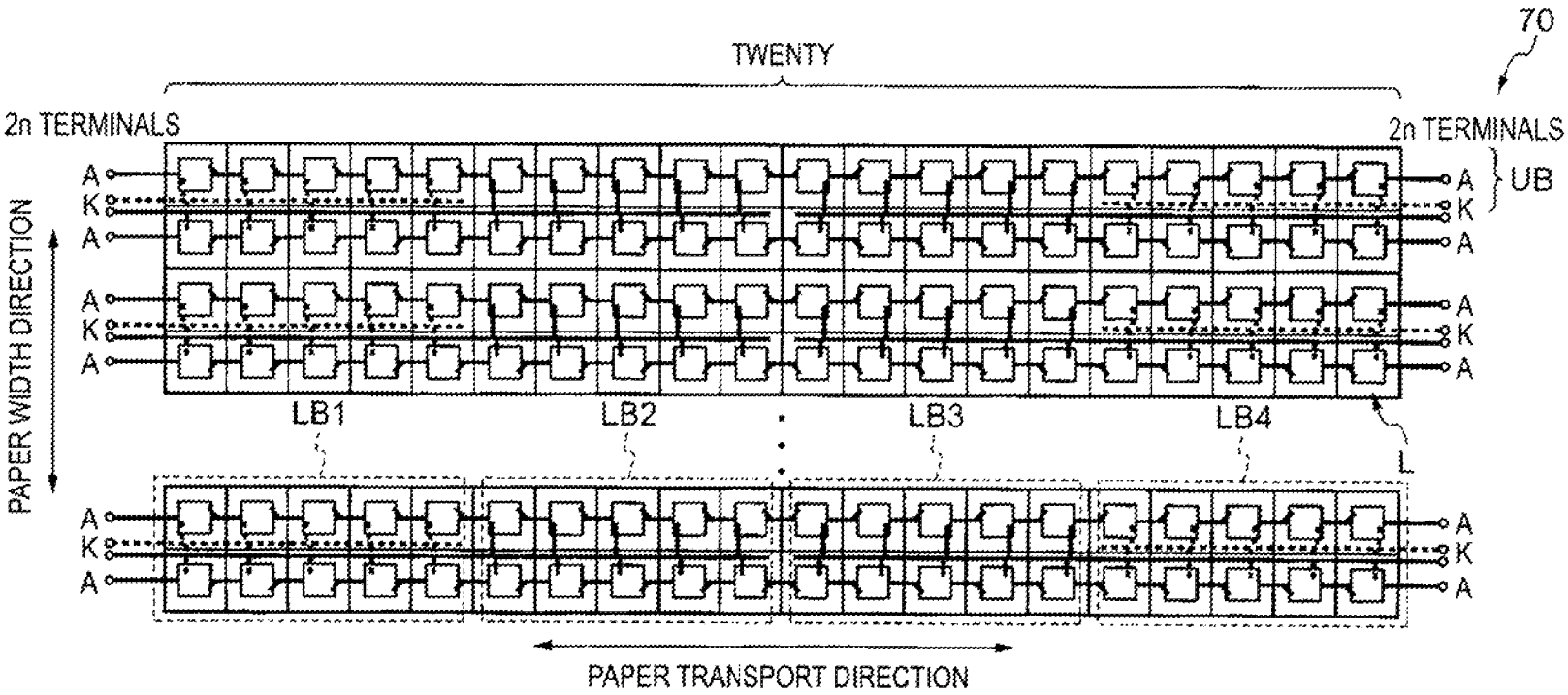
FIG. 18 is a diagram showing an example of a wiring in a laser element block.

Further, FIG. 18 is a diagram showing an example of another wiring of the laser element block LB in the laser drying device 70.

In the laser drying device 70 shown in FIG. 18, for example, one laser element block LB is constituted by a total ten laser elements L of five laser elements in the sheet transport direction by two laser elements in the sheet width direction. Four laser element blocks LB1 to LB4, having such a configuration, being lined up in the sheet transport direction are further disposed lined up in the sheet width direction by the number of m. At this time, an anode wiring connecting the respective terminals A of the laser elements L, which are located at the same position in the sheet width direction in the laser element block LB1 to LB4, is disposed so as to pass through the back faces of the respective laser elements L along the sheet transport direction.

On the other hand, a cathode wiring connecting the respective terminals K of the laser elements L within one laser element block LB is disposed so as to avoid the respective back faces of the laser elements L and to pass between the laser elements L lined up in the sheet width direction along the sheet transport direction.

Accordingly, the terminal A and the terminal K of each of the laser element blocks LB1 to LB4 are disposed along the sheet transport direction. Meanwhile, the laser elements L connected to each other in the manner shown in FIG. 5 are used as the laser elements L in FIG. 18.

At this time, as shown in FIG. 18, the terminals A and the terminals K of the laser element blocks LB1 and LB2 are disposed on the left side of the laser element block LB1, and the terminals A and the terminals K of the laser element blocks LB3 and LB4 are disposed on the right side of the laser element block LB4. Accordingly, a total of two terminals of one terminal A and one terminal K are disposed at each of both ends of the unit block UB including a total of twenty laser elements L of twenty laser elements in the sheet transport direction by one laser element in the sheet width direction are lined up.

In this manner, the number of terminals provided at one end of the unit block UB along the sheet transport direction is two in both the wiring of the laser element block LB shown in FIG. 17 and the wiring of the laser element block LB shown in FIG. 18. Accordingly, when n unit blocks UB are lined up in the sheet width direction, the total number of terminals provided at one end of the unit block UB along the sheet transport direction is 2n.

Figure 19:
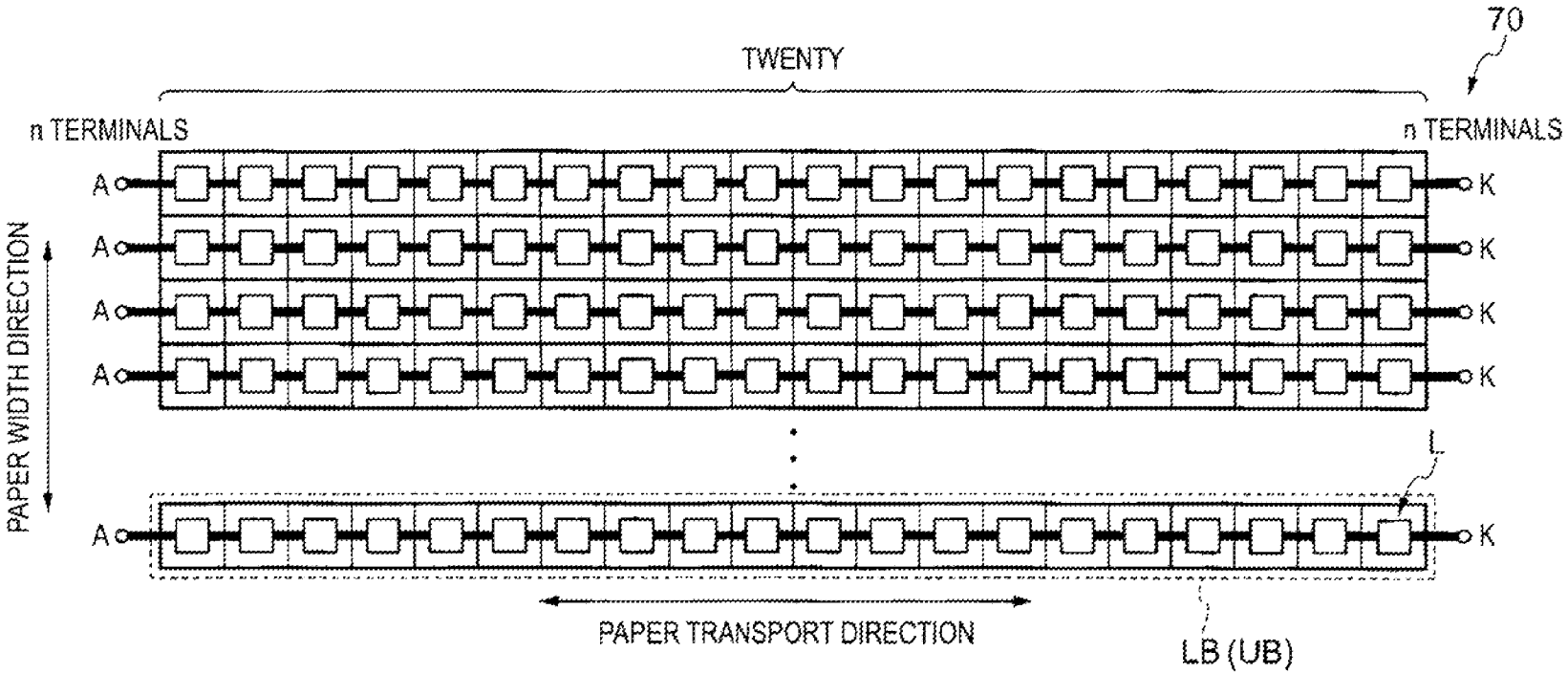
FIG. 19 is a diagram showing an example of a wiring in a laser element block.

In addition, FIG. 19 is a diagram showing an example of another wiring of the laser element block LB in the laser drying device 70.

In the laser drying device 70 shown in FIG. 19, twenty laser elements L (unit block UB), connected to each other in the manner shown in FIG. 10, are connected to each other in series in the sheet transport direction, and n unit blocks are further disposed lined up in the sheet width direction. At this time, the terminal A and the terminal K of the unit block UB are disposed along the sheet transport direction. That is, the terminal A is disposed at one end of the unit block UB in the sheet transport direction, and the terminal K is disposed at the other end thereof. Meanwhile, in this case, the unit block UB is equivalent to the laser element block LB.

Figure 20:
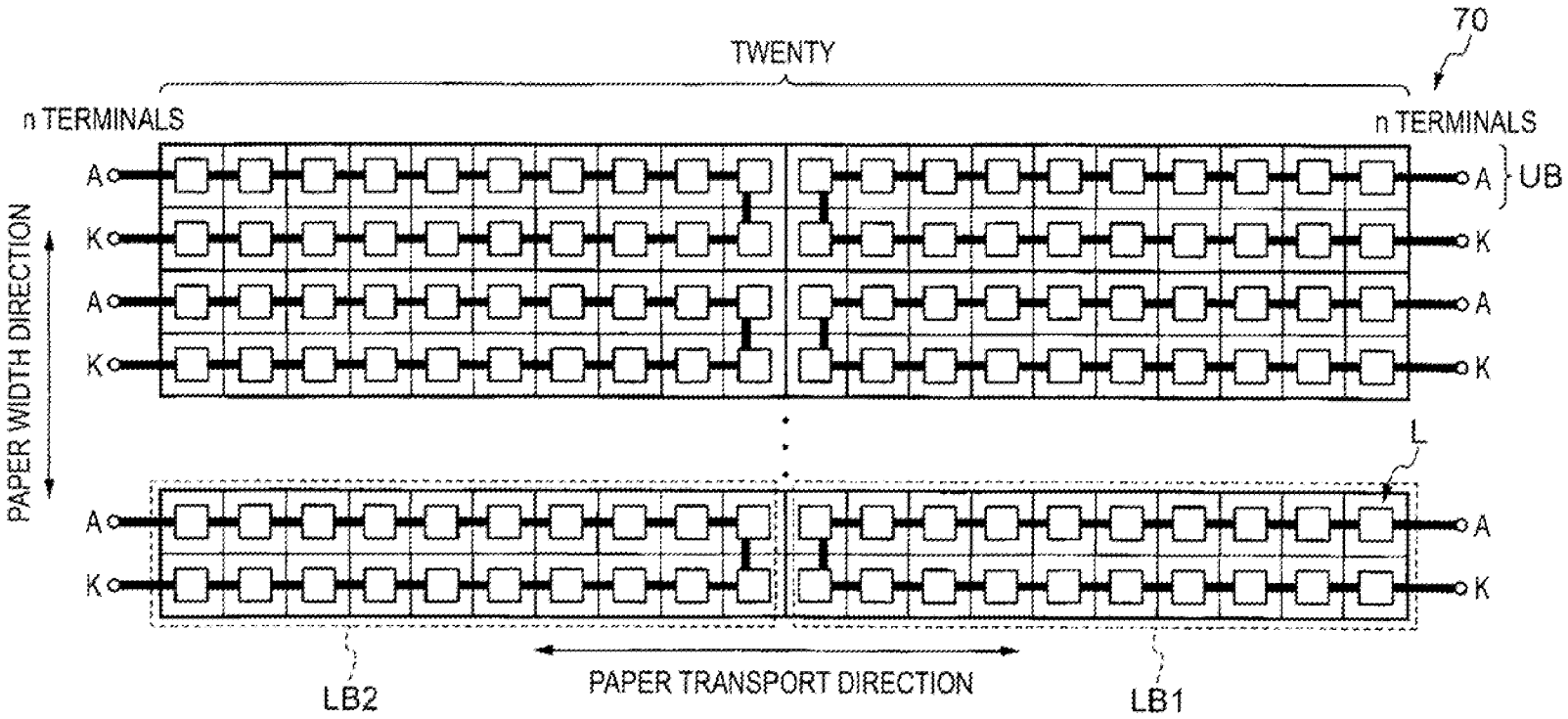
FIG. 20 is a diagram showing an example of a wiring in a laser element block.

Further, FIG. 20 is a diagram showing an example of another wiring of the laser element block LB in the laser drying device 70.

In the laser drying device 70 shown in FIG. 20, for example, one laser element block LB is constituted by a total of twenty laser elements L of ten laser elements in the sheet transport direction by two laser elements in the sheet width direction. Two laser element blocks LB1 and LB2, having such a configuration, being lined up in the sheet transport direction are further disposed lined up in the sheet transport direction by the number of m. The laser elements L within each laser element block LB are connected to each other in series in a U-shape, and the terminal A and the terminal K of the laser element block LB are disposed along the sheet transport direction.

Accordingly, one terminal A or one terminal K is disposed at each of both ends of the unit block UB in which a total of twenty laser elements L of twenty laser elements in the sheet transport direction by one laser elements in the sheet width direction are lined up. Meanwhile, the laser elements L connected to each other in the manner shown in FIG. 10 are used as the laser elements L in FIG. 20.

In this manner, the number of terminals provided at one end of the unit block UB along the sheet transport direction is one in both the wiring of the laser element block LB shown in FIG. 19 and the wiring of the laser element block LB shown in FIG. 20. Accordingly, when n unit blocks UB are lined up in the sheet width direction, the total number of terminals provided at one ends of the unit blocks UB along the sheet transport direction is n.

Meanwhile, the description has been given on the assumption that the ink jet recording device 10 according to this exemplary embodiment forms a color image on the continuous sheet P, but it is needless to say that the device may form a grayscale image.

Second Embodiment

Next, operations of an ink jet recording device 10 when executing a drying process according to this exemplary embodiment of the present invention will be described.

In the first embodiment, when the maximum front face printing rate within the laser irradiation region RB is greater than 0%, the laser element block LB is driven so that the irradiation intensity of the laser element block LB is set to a maximum irradiation intensity capable of being output in the laser element block LB. In addition, when the maximum front face printing rate within the laser irradiation region RB is 0%, the laser element block LB is driven so that the irradiation intensity of the laser element block LB is set to 0 W/cm$^2$, that is, the laser irradiation is stopped.

That is, the laser clement block LB is driven to be turned on or of according to whether ink drops are present within the laser irradiation region RB corresponding to the laser element block LB.

In this exemplary embodiment, a description will be given of a drying process of providing the irradiation intensity of a laser emitted from a laser element block LB in plural steps and changing the irradiation intensity of the laser in accordance with a maximum front face printing rate within a laser irradiation region RB corresponding to the laser element block LB.

Meanwhile, main components of the ink jet recording device 10 according to this exemplary embodiment are the same as those in FIG. 1, and main electrical components are also the same as those in FIG. 11, and thus a description thereof will be omitted.

Figure 21:
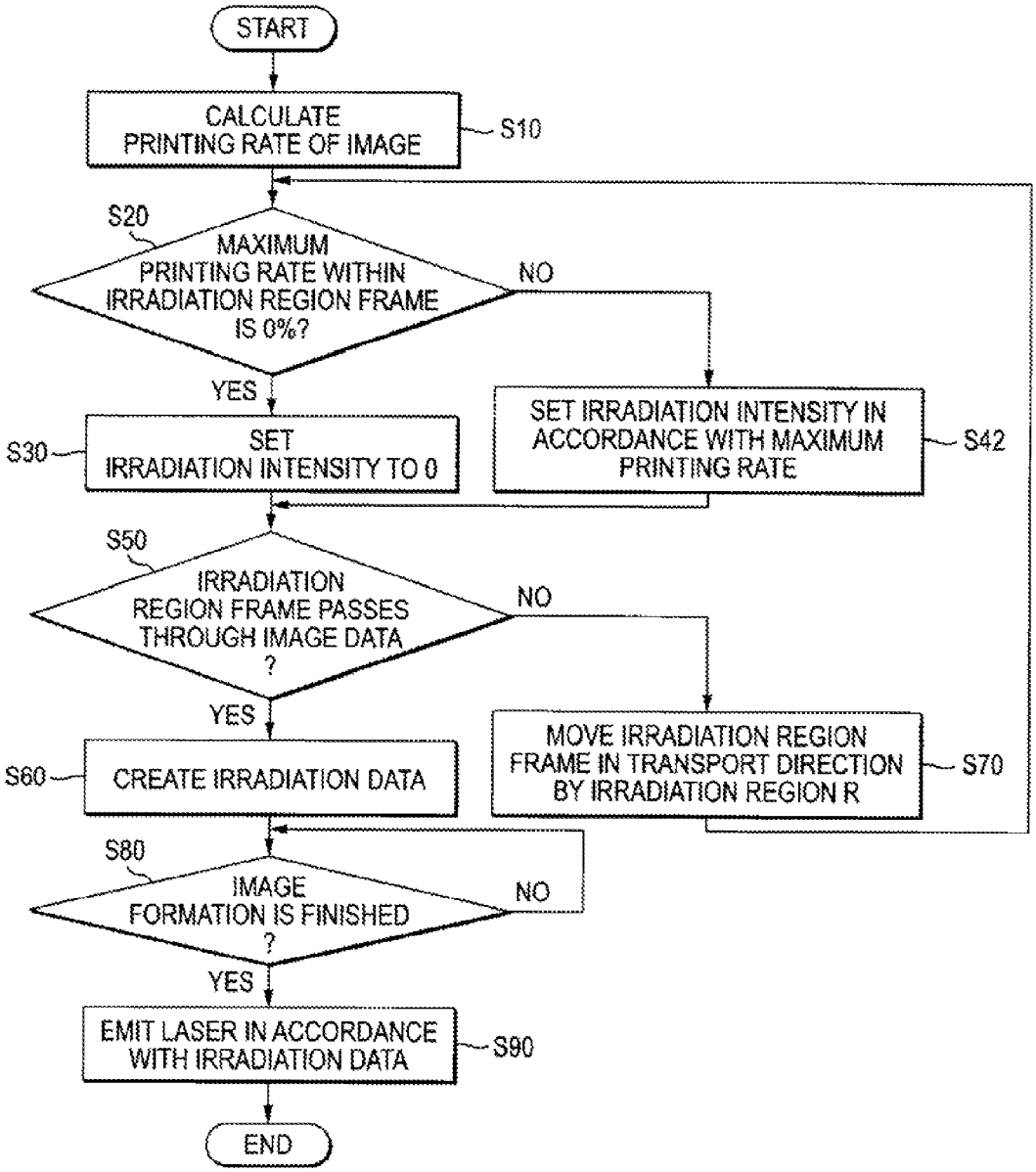
FIG. 21 is a flow chart of a drying program according to the second embodiment.

FIG. 21 is a flow chart showing a flow of processing of a drying program executed by a CPU 201 of a computer 20, for example, when a request for forming an image is received from a user.

Meanwhile, the drying program is not limited to a configuration in which the program is installed in advance in a ROM 202 and is provided, and a configuration may he adopted in which the program is provided in a state where the program is stored in a computer-readable recording medium such as a CD-ROM or a memory card. In addition, a configuration may be adopted in which the program is distributed in a wired or wireless manner through a communication line I/F120, or the like.

The flow chart of the drying program shown in FIG. 21 is different from the flow chart of the drying program according to the first embodiment shown in FIG. 12 in that the process of step S40 is replaced by the process of step S42. Processes in other steps are the same as those in the drying program according to the first embodiment, and thus a description thereof will be omitted.

In step S42, the irradiation intensity of the laser emitted from the laser clement block LB is set with reference to an irradiation intensity table.

FIG. 22 is a diagram showing an example of the irradiation intensity table.

The irradiation intensity table is a table in which a range of a maximum front face printing rate within an irradiation region frame 4 and the irradiation intensity of the laser element block LB in the range are specified, and is stored in advance, for example, in a region of a non-volatile memory 204 which is determined in advance.

Specifically, for example, when a maximum front face printing rate 1 within the irradiation region frame 4 is $0<I\leq C_c$ [%], an irradiation intensity in the laser element block LB is set to $I_3$. When the maximum front face printing rate is $C_c<I\leq C_b$[%], an irradiation intensity is set to $I_2$. When the maximum front face printing rate is $C_b<I\leq C_a$[%], an irradiation intensity is set to $I_1$. Meanwhile, a magnitude relation of the irradiation intensity is set to $0<I_3<I_2<I_1$. This is because as the maximum front face printing rate within the irradiation region frame 4 increases, the capacity of ink drops dried by laser irradiation is increased.

Figure 23:
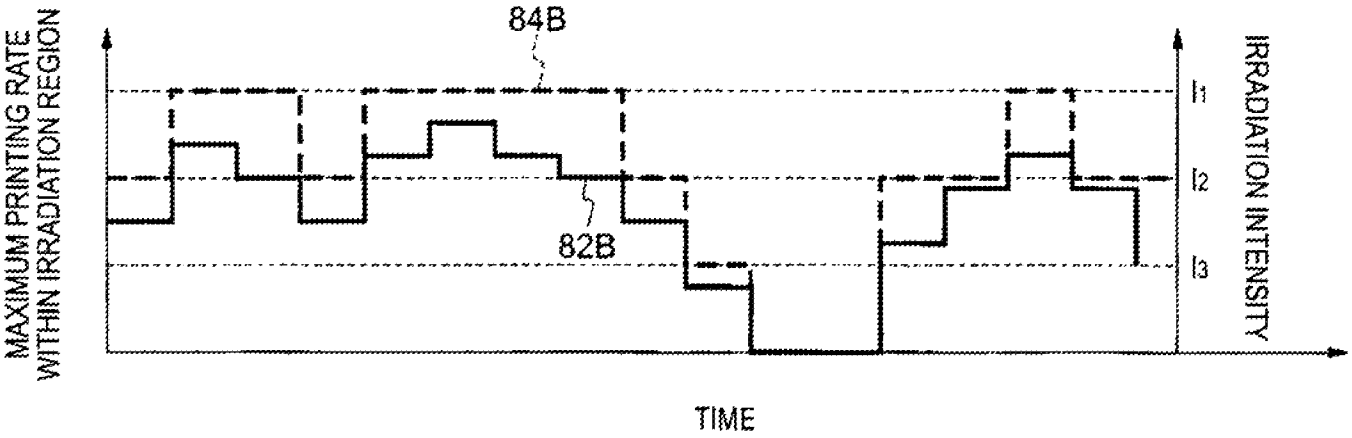
FIG. 23 is a graph showing irradiation intensity of a laser emitted from a laser element block according to the second embodiment.

FIG. 23 is a graph showing an example of a laser irradiation intensity in the laser element block LB when a laser drying device 70 is driven on the basis of the drying program shown in FIG. 21.

A graph 82B of FIG. 23 is a graph showing an example of a maximum front face printing rate within the laser irradiation region RB corresponding to the laser element block LB. In addition, a graph 84B is a graph showing an example of the irradiation intensity of a laser emitted from the laser element block LB.

As shown in FIG. 23, the irradiation intensity of the laser emitted from the laser dement block LB according to this exemplary embodiment is changed in four steps of 0, $I_1$, $I_2$, and $I_3$ in accordance with the maximum front face printing rate within the laser irradiation region RB.

Accordingly, when the maximum front face printing rate within the laser irradiation region RB is greater than 0%, energy consumption required when drying ink drops is further suppressed, as compared with the method of driving the laser element block LB of the first embodiment in which the irradiation intensity of the laser element block LB is uniformly set to $I_1$.

Meanwhile, in this exemplary embodiment, the irradiation intensity of the laser emitted from the laser element block LB is set in four steps, but the number of steps of the irradiation intensity of the laser emitted from the laser element block LB is not limited to four. The number of steps of the irradiation intensity of the laser emitted from the laser element block LB is set to more than four, and thus a further suppression of energy consumption is achieved.

Meanwhile, similarly to the first embodiment, the laser drying device 70 according to this exemplary embodiment is configured such that a laser emitted from the laser element block LB is stopped when the maximum front face printing rate within the laser irradiation region RB is 0%, but the value of the maximum front face printing rate for stopping the laser is not limited thereto. For example, when the maximum front face printing rate within the laser irradiation region RB is less than a front face printing rate requiring laser irradiation, the laser emitted from the laser element block LB may be stopped.

Third Embodiment

Next, operations of an ink jet recording device when executing a drying process according to this exemplary embodiment of the present invention will be described.

In the first and second embodiments, the irradiation intensity of a laser emitted from a laser element block LB is set on the basis of a front thee printing rate within a laser irradiation region RB.

In this exemplary embodiment, the irradiation intensity of a laser emitted from the laser element block LB is set by further adding a back face priming rate within the same laser irradiation region RB, in addition to the front face printing rate within the laser irradiation region RB.

Figure 24:
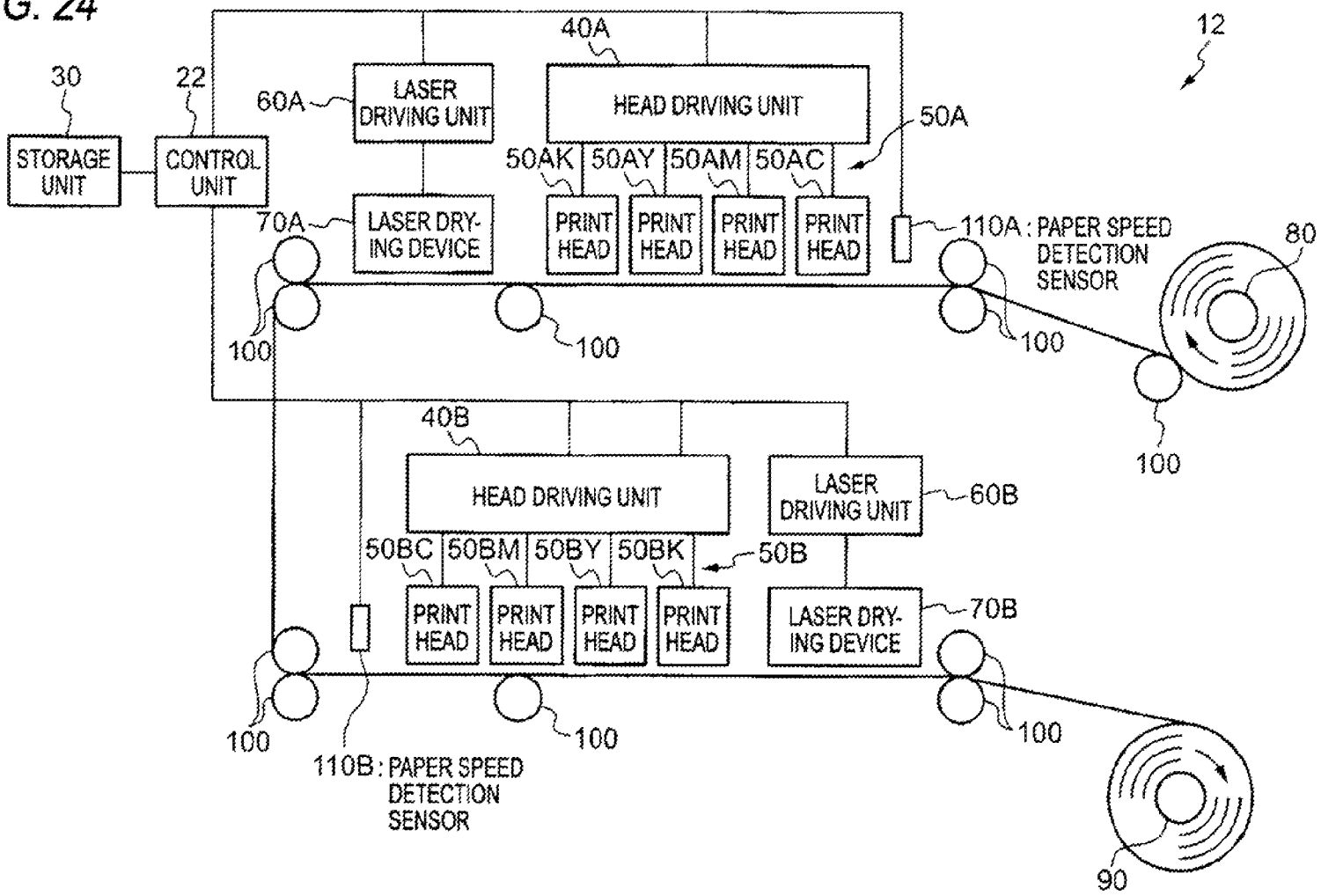
FIG. 24 is a schematic configuration diagram of an ink jet recording device according to a third embodiment and a fourth embodiment.

FIG. 24 shows an example of a schematic configuration diagram showing main components of an ink jet recording device 12 according to this exemplary embodiment.

The ink jet recording device 12 forms an image corresponding to image information on both faces of a continuous sheet P. For this reason, the ink jet recording device 12 includes two sets of component groups each of which includes a head driving unit 40, print heads 50 corresponding to colors Y, M, C, and K, a laser driving unit 60, a laser drying device 70, and a sheet speed detection sensor 110. First, an image is formed on one face of the continuous sheet P by one set of component groups in which a symbol 'A' is attached to the ends of signs, and an image is formed on the other face of the continuous sheet P by the other set of component groups in which a symbol 'B' is attached to the ends of signs.

Meanwhile, when the component groups are not required to be distinguished from each other, a description will be given by omitting the symbol 'A' and the symbol 'B' at the ends of the signs.

In addition, image information formed on each of the faces of the continuous sheet P is stored in the storage unit 30.

In this manner, for double-sided printing, the ink jet recording device 12 includes two sets of component groups in the same manner as the ink jet recording device 10 according to the first embodiment. The ink jet recording device 12 performs the same process as the process of the ink jet recording device 10 on each face of the continuous sheet P by controlling the component groups by a control unit 22.

Figure 25:
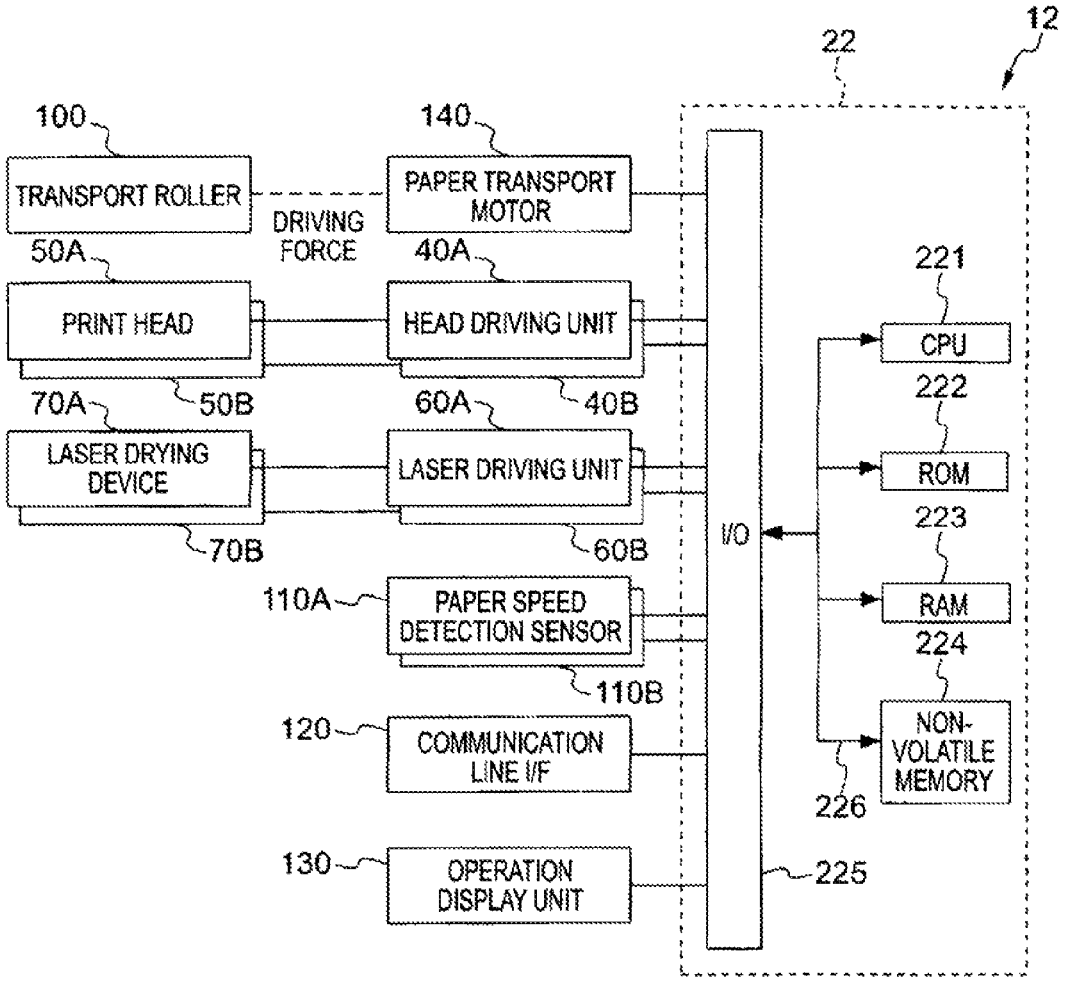
FIG. 25 is a block diagram showing main electrical components of the ink jet recording device according to the third embodiment and the fourth embodiment.

FIG. 25 is a diagram showing main electrical components in the ink jet recording device 12.

FIG. 25 is different from FIG. 11 showing the main electrical components of the ink jet recording device 10 in that two sets are provided, each of which includes the head driving units 40, the print heads 50, the laser driving units 60, the laser drying devices 70, and the sheet speed detection sensors 110 which are connected to an I/O 225. The other components are the same as the main electrical components of the ink jet recording device 10 shown in FIG. 11.

Next, a method of driving laser drying devices 70A and 70B in the ink jet recording device 12 will be described.

First, a laser driving unit 60A drives the laser drying device 70A using the same method as the method of driving the laser drying device 70 according to the first embodiment or the second embodiment described above and dries ink drops ejected onto one face of the continuous sheet P to fix an image onto the continuous sheet P.

On the other hand, when the laser driving unit 60B drives the laser drying device 70B, the laser drying device 70B is driven using a method different from the method of driving the laser drying device 70 according to the first embodiment or the second embodiment. Specifically, the irradiation intensity of the laser element block LB is set on the basis of a front face printing rate and a back face printing rate in a laser irradiation region R corresponding to each of laser elements L included in the laser element block LB of the laser drying device 70B.

Here, the back face printing rate refers to a printing rate of the continuous sheet P on a face (back face) opposite to a laser irradiation surface included in the laser irradiation region R corresponding to each of the laser elements L.

In this manner, the irradiation intensity of a laser emitted from the laser element block LB is set. This is because when ink drops are present on the back face of the continuous sheet P, the ink drops on the back face of the continuous sheet P may generate heat by absorbing irradiation energy of a laser with which the front face of the continuous sheet P is irradiated.

That is, when ink drops are present on both faces of the continuous sheet P, the continuous sheet P is heated not only from the front face thereof but also the back face thereof in spite of the front face of the continuous sheet P being irradiated with the laser. Accordingly, even when the continuous sheet P is irradiated with a laser having the same irradiation intensity in order to dry the ink drops on the front face of the continuous sheet P, the drying of the ink drops on the front face of the continuous sheet P is promoted when the ink drops are present on both faces of the continuous sheet P, as compared with a case where ink drops are present on only a front face.

That is, when the irradiation intensity of a laser emitted from the laser element block LB is set, it may be possible to further reduce a laser irradiation intensity required to dry ink drops in consideration of not only a front face printing rate but also a back face printing rate in the laser irradiation region R. Accordingly, an effect of suppressing energy consumption required when drying ink drops is expected.

Next, an example of a method of setting a laser irradiation intensity of the laser element block LB in the ink jet recording device 12 will be described in detail on the basis of the above-described knowledge.

Now, a front face printing rate in the laser irradiation region R corresponding to one laser element L included in the laser element block LB is set to CovA, and a laser irradiation intensity required to dry ink drops having the front face printing rate CovA is set to $I_A$.

When a back face printing rate in the same laser irradiation region R having a front face printing rate of CovA is CovB, an irradiation factor K is selected in accordance with a magnitude relation between the front face printing rate CovA and the back face printing rate CovB. For example, the irradiation factor K is set to 1 in a case of the back face printing rate CovB≤the front face printing rate CovA, and the irradiation factor is set to 0.8 in a case of the front face printing rate CovA<the back face printing rate CovB. A laser irradiation intensity required for the laser irradiation region R is set to ($I_A$×K).

The above-described calculation is executed for each laser irradiation region R corresponding to the laser element L included in the laser element block LB, and a maximum laser irradiation intensity, in the laser irradiation intensities required for the laser irradiation region R included in the laser element block LB, is set as a laser irradiation intensity in the laser element block LB.

Meanwhile, in the above-described example, the irradiation factor K is determined according to whether the back face printing rate CovB is equal to or less than the front face printing rate CovA, but a method of determining the irradiation factor K is not limited thereto. For example, it is needless to say that the irradiation factor K is also determined by other methods such as a method of determining the irradiation factor K in accordance with a rate of the back face printing rate CovB with respect to the front face printing rate CovA. In addition, an allowable value for the irradiation factor K is not limited.

However, in order to suppress energy consumption required when drying ink drops, it is preferable that the irradiation factor K be set to decrease as the value of the back face printing rate CovB increases.

The above-described drying process can be realized by a software configuration using a computer by executing a program.

Figure 26:
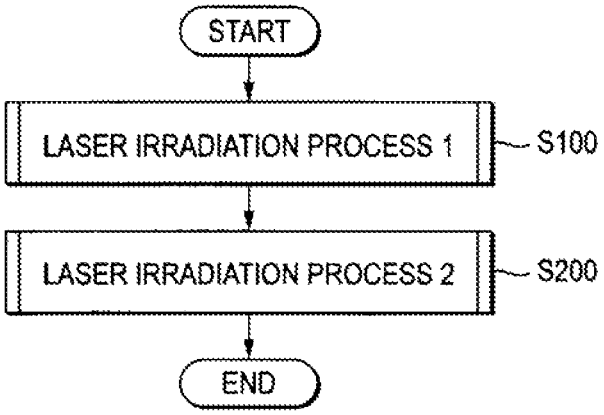
FIG. 26 is an overall flow chart of a drying program according to the third embodiment and the fourth embodiment.

FIG. 26 is a flow chart showing a flow of processing of a drying program executed by a CPU 221 of the computer 22, for example, when a request for forming an image is received from a user.

Meanwhile, the drying program is not limited to a configuration in which the program is installed in advance in the ROM 222 and is provided, and a configuration may be adopted in which the program is provided in a state where the program is stored in a computer-readable recording medium such as a CD-ROM or a memory card. In addition, a configuration may be adopted in which the program is distributed in a wired or wireless manner through the communication line I/F120, or the like.

First, in step S100, for example, the laser driving unit 60A is driven in accordance with the flow chart according to the second embodiment shown in FIG. 21, and one face of the continuous sheet P is irradiated with a laser from the laser drying device 70A.

Next, in step S200, the laser driving unit 60B is driven in accordance with a flow chart, shown in FIG. 27, to be described later, and the face opposite to the face of the continuous sheet P, which is irradiated with the laser in the process of step S100, is irradiated from a laser from the laser drying device 70B.

Figure 27:
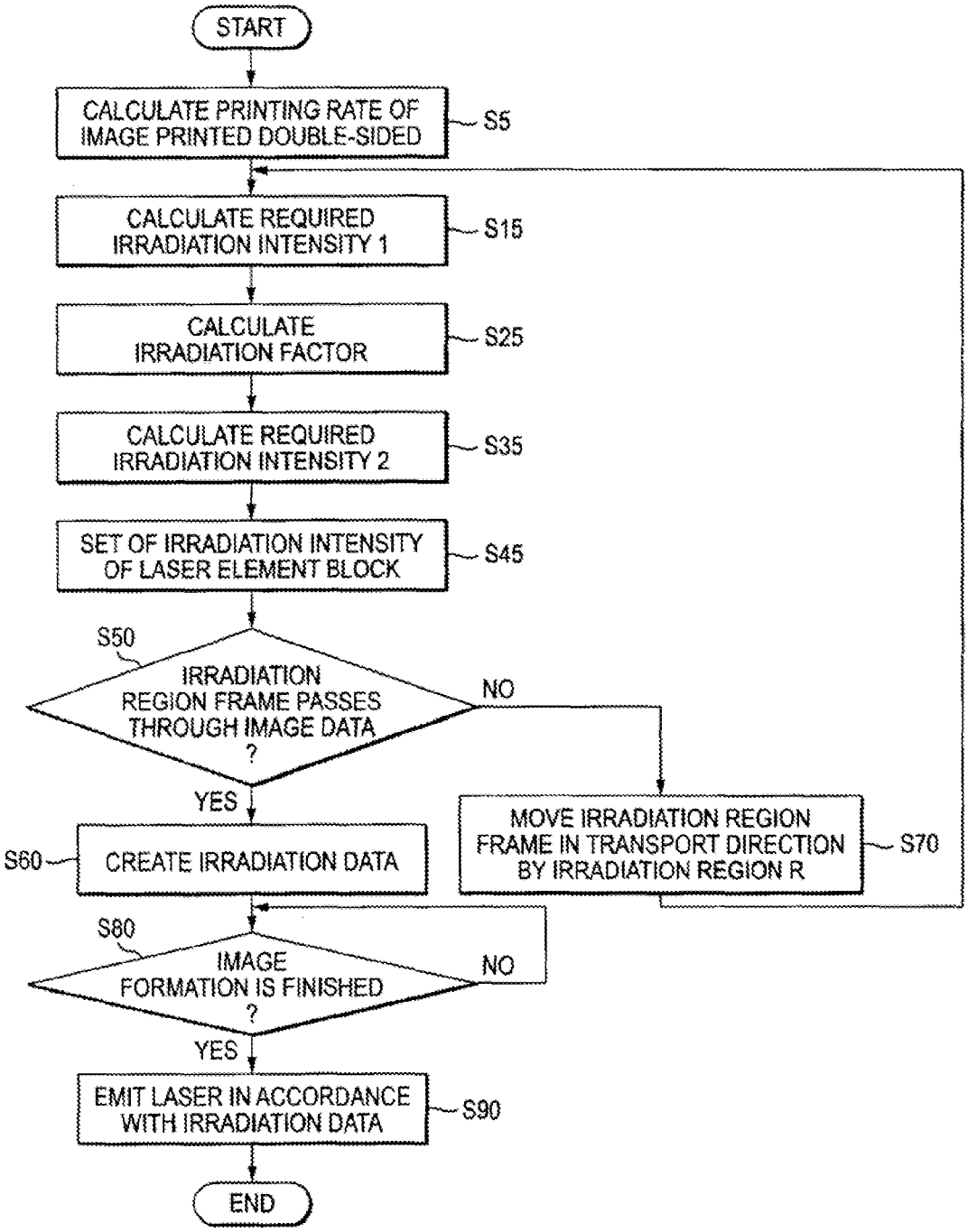
FIG. 27 is a flow chart of a drying program according to the third embodiment.

FIG. 27 is a flow chart showing a flow of processing in step S200. Meanwhile, it is assumed that image information includes image data 2A corresponding to an image formed on the continuous sheet P in the process of step S100 and image data 2B corresponding to an image formed on the continuous sheet P in the process of step S200.

First, in step S5, for example, image information stored in advance in a region of a RAM 223 which is determined in advance is acquired. The image data 2A and the image data 2B, which are included in the image information, are developed in the region of the RAM 223 which is determined in advance.

Next, the image data 2A and the image data 2B which are developed in the RAM 223 are divided into the size of the laser irradiation region R corresponding to the laser element L used in the laser drying device 70B. A front face printing rate of each of the pieces of image data 2A and 2B is calculated for each laser irradiation region R, and the calculated front face printing rate is stored in the RAM 223 in association with the corresponding laser irradiation regions R of the pieces of image data 2A and 2B. Meanwhile, specifically, the front face printing rate of the image data refers to a front face printing rate when image data is formed as an image on the continuous sheet P.

In step S15, for example, an irradiation intensity (required irradiation intensity 1) for the front face printing rate for each laser irradiation region R of the image data 2B, which is calculated in the process of step S5, is calculated with reference to the irradiation intensity table shown in FIG. 22. Then, the calculated required irradiation intensity 1 for each laser irradiation region R is stored in the RAM 223 in association with the corresponding laser irradiation region R of the image data 2B.

Meanwhile, when the front face printing rate of the laser irradiation region R is 0%, the required irradiation intensity 1 is set to 0 W/cm$^2$.

In step S25, the laser irradiation region R of the image data 2A disposed on the back of the laser irradiation region R of the image data 2B is associated for each laser irradiation region R of the image data 2B. A front face printing rate of the associated laser irradiation region R of the image data 2A is acquired from the RAM 223 as a back face printing rate of the image data 2B in the laser irradiation region R.

The front face printing rate and the back face printing rate of the image data 2B in the laser irradiation region R are compared with each other for each laser irradiation region R, and thus an irradiation factor K in the laser irradiation region R is determined and is stored in the RAM 223 in association with the corresponding laser irradiation region R of the image data 2B.

Meanwhile, as an example, in a case of the back face printing rate of the image data 2B≤the front face printing rate of the image data 2B, the irradiation factor K is set to 1, and in a case of the front face printing rate of the image data 2B<the back face printing rate of the image data 2B, the irradiation factor K is set to 0.8.

In step S35, an irradiation intensity (required irradiation intensity 2) for each laser irradiation region R of the image data 2B is calculated by multiplying the required irradiation intensity 1 for each laser irradiation region R of the image data 2B which is calculated in the process of step S15 by the irradiation factor K for each laser irradiation region R of the image data 2B which is calculated in the process of step S25. The calculated required irradiation intensity 2 for each laser irradiation region R is stored in the RAM 223 in association with the corresponding laser irradiation region R of the image data 2B.

In step S45, an irradiation region frame 4 having the same size as the laser irradiation region RB corresponding to the laser element block LB used in the laser drying device 70B is virtually disposed on the image data 2B which is developed in the RAM 223 in the process of step S5. The maximum required irradiation intensity 2 in the required irradiation intensities 2 associated with the respective laser irradiation regions R included in the irradiation region frame 4 is set as a laser irradiation intensity at the position of the irradiation region frame 4.

Meanwhile, a method of disposing the irradiation region frame 4 for the image data 2B is the same as the method described in the process of step S20 in FIG. 12.

Hereinafter, irradiation data is created for each laser element block LB included in the laser drying device 70B by executing the processes of step S60 to step S90 of FIG. 12 described above, and a switching element included in the laser driving unit 60B is driven on the basis of the created irradiation data.

FIG. 28 is a diagram illustrating a process of setting a laser irradiation intensity at the position of the irradiation region frame 4, which is executed by the processes of step S5 to step S45, when the laser irradiation regions R corresponding to ten laser elements L1 to L10 are included in the irradiation region frame 4.

First, as a result of the process of step S5, the front face printing rates of the image data 2A and the image data 2B are calculated for each laser irradiation region R, and the front face printing rate of the image data 2B is set in a cell in a front face printing rate row.

Next, as a result of the process of step S15, the required irradiation intensity 1 is calculated for each laser irradiation region R. As a result of the process of step S25, the front face printing rate of the image data 2A disposed on the back of the laser irradiation region R is associated with the back face printing rate, and the front face priming rate is compared with the back face printing rate, and thus the irradiation factor K for each laser irradiation region R is determined.

Then, as a result of the process of step S35, the required irradiation intensity 1 is multiplied by the irradiation factor K for each laser irradiation region R, and thus the required irradiation intensity 2 is calculated.

As a result of the process of step S45, the maximum required irradiation intensity 2 in the required irradiation intensities 2 is set as the irradiation intensity of a laser emitted from the laser element block LB at the position of the irradiation region frame 4. Meanwhile, in the example of FIG. 28, since the required irradiation intensity 2 in the laser irradiation region R corresponding to a laser element No. L6 has a maximum value of 50 W/cm$^2$, the irradiation intensity of the laser emitted from the laser element block LB at the position is set to 50 W/cm$^2$.

As described above, in this exemplary embodiment, when double-sided printing is performed on the continuous sheet P, a laser irradiation intensity for each laser element block LB included in the laser drying device 70B is set on the basis of a printing rate of the continuous sheet P on a laser irradiation surface, in more detail, the front face printing rate and the back face printing rate.

In this case, energy consumption required when drying ink drops ejected onto the continuous sheet P is further suppressed, as compared with a case where the laser drying device 70B is driven in accordance with the drying process described in the first embodiment or the second embodiment.

Meanwhile, in this exemplary embodiment, as shown in FIG. 26, the laser driving unit 60A and the laser driving unit 60B are driven according to different flow charts, but a method of driving the laser driving unit 60A and the laser driving unit 60B is not limited thereto.

For example, a configuration may be adopted in which the process of step S100 is replaced by the process of step S200 shown in FIG. 27 and the laser driving unit 60A and the laser driving unit 60B are driven by a common drying process.

In this case, the image data 2B is read into the image data 2A and the image data 2A is read into the image data 2B in the processes of step S5 to step S45 in FIG. 27. In addition, it may be assumed that a front face printing rate in each of the laser irradiation regions R of the image data 2B is 0%.

In addition, the process of step S100 may be replaced by the drying process shown in FIG. 12.

Meanwhile, in this exemplary embodiment, when the front face printing rates of the image data A and the image data B in the laser irradiation region R are less than a front face printing rate requiring laser irradiation, the front face printing rate may be regarded as 0%.

Fourth Embodiment

Next, operations of an ink jet recording device 12 when executing a drying process according to this exemplary embodiment of the present invention will be described.

In the first to third embodiments, the irradiation intensity of a laser emitted from the laser element block LB is set on the basis of a printing rate of a continuous sheet P included in a laser irradiation region R corresponding to each of laser elements L of a laser element block LB.

In this exemplary embodiment, the irradiation intensity of the laser emitted from the laser element block LB is set on the basis of the printing rate of the continuous sheet P included in the laser irradiation region R and a transport speed of the continuous sheet P.

Meanwhile, main components of the ink jet recording device 12 according to this exemplary embodiment are the same as those in FIG. 24 and main electrical components are also the same as those in FIG. 25, and thus a description thereof will be omitted.

Now, in one laser element block LB, energy required when drying ink drops having the amount of ink which is determined in advance is set to E [J/cm$^2$], and a length of the laser element block LB in the sheet transport direction is set to L [cm]. At this time, when the transport speed of the continuous sheet P is set to V [cm/s], a laser irradiation intensity required for the laser element block LB is indicated by E/(L/V) [W/cm$^2$].

Since the length L of the laser element block LB along the sheet transport direction is determined in advance, the laser irradiation intensity of the laser element block LB, which is required to dry ink drops having the amount of ink determined in advance, is proportional to the transport speed of the continuous sheet P.

This indicates that when ink drops having the same amount of ink which is determined in advance are dried, the laser irradiation intensity of the laser element block LB required for drying may be decreased as the transport speed V of the continuous sheet P decreases.

Consequently, in the ink jet recording device 12 according to this exemplary embodiment, an upper limit of the irradiation intensity of the laser is changed for each laser element block LB. Even when created irradiation data is data instructing a laser having an irradiation intensity exceeding the upper limit to be emitted from the laser element block LB, the irradiation intensity of the laser is limited to the upper limit.

In this manner, each of the laser element blocks LB is driven, and thus ink drops are prevented from being irradiated with a laser having energy exceeding energy required to dry ink drops, and the suppression of energy consumption required to dry the ink drops is achieved.

Figure 29:
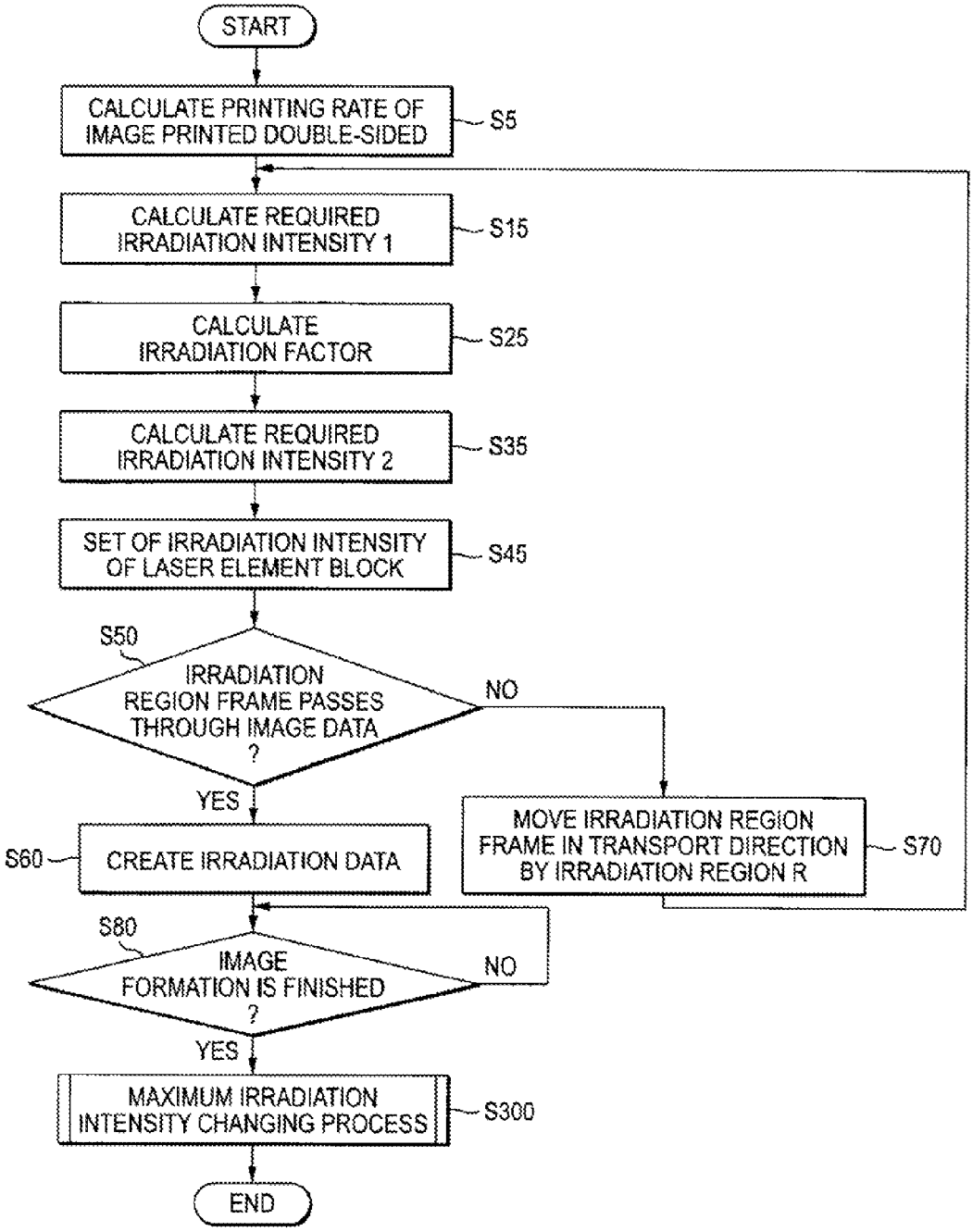
FIG. 29 is a flow chart of a drying program according to the fourth embodiment.

FIG. 29 shows a flow chart of processing executed in step S200 in the flow chart showing the flow of the processing of the drying program of FIG. 26 according to the third embodiment.

The flow chart of FIG. 29 is different from the flow chart of FIG. 27 showing the process of step S200 according to the third embodiment in that the process of step S90 is replaced by the process of step S300.

Meanwhile, the drying program is not limited to a configuration in which the program is installed in advance in a ROM 222 and is provided, and a configuration may be adopted in which the program is provided in a state where the program is stored in a computer-readable recording medium such as a CD-ROM or a memory card. In addition, a configuration may be adopted in which the program is distributed in a wired or wireless manner through a communication line I/F 120, or the like.

Figure 30:
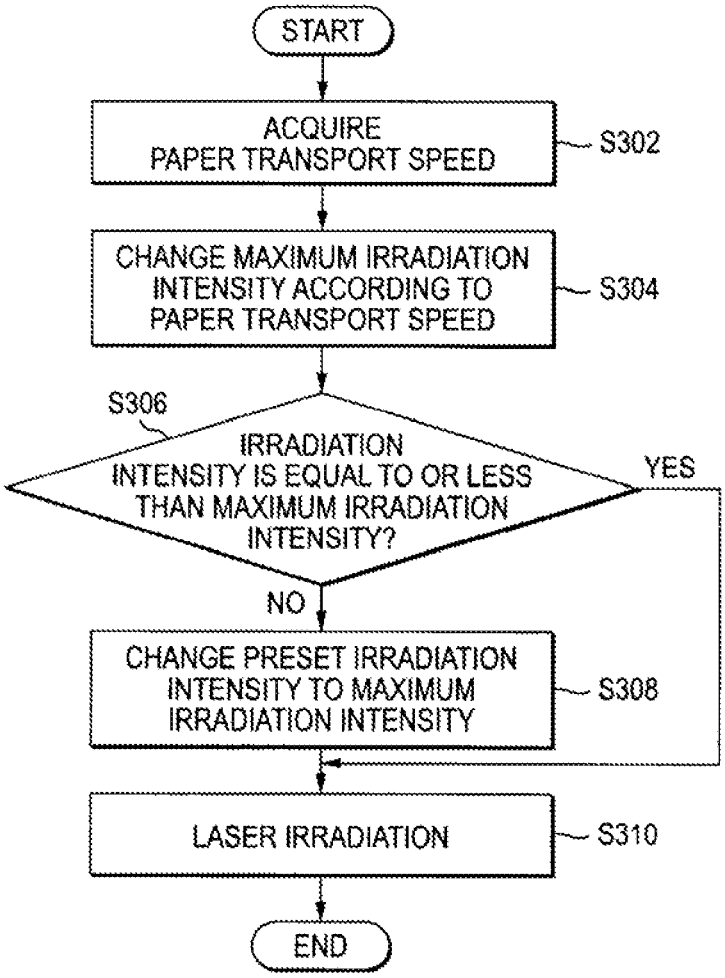
FIG. 30 is a flow chart showing a flow of a maximum irradiation intensity changing process.

FIG. 30 is a flow chart showing a flow of a maximum irradiation intensity changing process in step S300.

First, in step S302, a transport speed of the continuous sheet P is acquired from a sheet speed detection sensor 110B, and is stored in, for example, a region of a RAM 223 which is determined in advance.

In step S304, an upper limit of a laser irradiation intensity for the transport speed of the continuous sheet P which is acquired in step S302 is acquired with reference to an upper limit table in which the transport speed of the continuous sheet P is associated with an upper limit of the laser irradiation intensity in the transport speed.

Meanwhile, the upper limit table is obtained in advance by an experiment using a real machine of the ink jet recording device 12, a computer simulation based on design specifications of the ink jet recording device 12, or the like, and is stored in advance, for example, in a region of a non-volatile memory 224 which is determined in advance. Meanwhile, the upper limit table is set such that the laser irradiation intensity of the laser element block LB required for drying is decreased as the transport speed of the continuous sheet P decreases.

In this step, the upper limit of the laser irradiation intensity is acquired with reference to the upper limit table. However, the upper limit of the laser irradiation intensity may be acquired using an expression in which the transport speed of the continuous sheet P is used as an explanatory variable and the upper limit of the laser irradiation intensity is used as an objective variable.

In step S306, the irradiation intensity of the laser element block LB at each irradiation timing, which is determined by the irradiation data created in the process of step S60 of FIG. 29, is compared with the upper limit of the laser irradiation intensity which is acquired in step S304. It is determined whether the irradiation intensity of the laser element block LB at each irradiation timing which is determined by the irradiation data is equal to or less than the upper limit of the laser irradiation intensity. In a case of a negative determination, the processing proceeds to step S308.

In step S308, among the irradiation intensities of the laser element blocks LB at the irradiation timings which are determined by the irradiation data, a value exceeding the upper limit of the laser irradiation intensity is changed to the upper limit of the laser irradiation intensity. As a result of the process of this step, the irradiation intensity of the laser emitted from the laser element block LB is limited to the upper limit.

On the other hand, when an affirmative determination is made in the process of step S306, the process of step S308 is omitted, and the processing proceeds to step S310.

In step S310, a switching element that drives the laser element block LB corresponding to the irradiation data is controlled at a timing which is determined by the irradiation data. A laser having the irradiation intensity determined by the irradiation data is emitted from the laser element block LB, and this program is terminated.

Meanwhile, the description has been given on the assumption that the upper limit table according to this exemplary embodiment is set so that the irradiation intensity of the laser emitted from the laser element block LB is decreased as the transport speed of the continuous sheet P decreases, but the setting of the upper limit table is not limited thereto.

For example, when the transport speed of the continuous sheet P is reduced to equal to or less than a speed determined in advance due to defects of the sheet transport motor 140 or the like, it is considered that the continuous irradiation of the continuous sheet P with a laser may cause ink drops to be dried more than necessary and may result in an increase in the internal temperature of the ink jet recording device 12 due to the laser irradiation. Accordingly, when the transport speed of the continuous sheet P is reduced to equal to or less than a speed determined in advance, the laser emitted from the laser element block LB may be stopped.

Here, the speed determined in advance refers to a transport speed that may cause the temperature in the ink jet recording device 12 to exceed an allowable operation temperature when the continuous sheet P transported at a transport speed equal to or greater than the speed is continuously irradiated with a laser.

Figure 31:
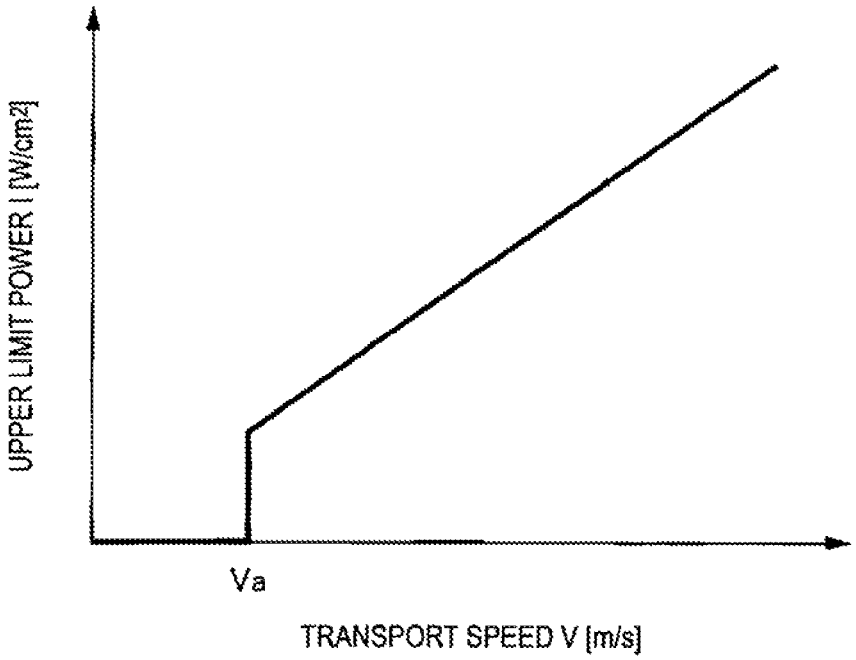
FIG. 31 is a diagram showing an example of an upper limit of a laser irradiation intensity.

FIG. 31 is a diagram showing an upper of a laser irradiation intensity corresponding to this case.

As shown in FIG. 31, when a transport speed of the continuous sheet P is equal to or less than a speed Va, an upper limit of the irradiation intensity of the laser clement block LB is set to 0 W/cm$^2$.

As described above, in this exemplary embodiment, the irradiation intensity of a laser emitted from the laser element block LB is limited to an upper limit determined on the basis of the transport speed of the continuous sheet P. In addition, when the transport speed of the continuous sheet P is equal to or less than the speed determined in advance, the laser emitted from the laser element block LB is stopped.

Accordingly, energy consumption required when drying ink drops ejected onto the continuous sheet P is further suppressed.

Meanwhile, in this exemplary embodiment, step S90 in FIG. 27 is replaced by the process shown in FIG. 30. However, it is needless to say that step S90 of the drying process shown in FIG. 12 according to the first embodiment and FIG. 21 according to the second embodiment may be replaced by the process shown in FIG. 30. In this case, a further decrease in energy consumption required when drying ink drops is expected, as compared with the drying process shown in FIGS. 12 and 21.

In addition, the description has been given on the assumption that the ink jet recording device 12 includes sheet speed detection sensors 110A and 110B. However, when the transport speed of the continuous sheet P is the same at any point on a transport path of the continuous sheet P, the sensors may be integrated into any one sheet speed detection sensor. In addition, for example, the transport speed of the continuous sheet P may be obtained by installing an encoder, outputting the number of pulses corresponding to a rotation angle, in the discharge roll 90 and by measuring the number of pulses per unit time.

Up to here, although the present invention has been described with reference to this exemplary embodiment, the technical scope of the present invention is not limited to the scope described in the above-described exemplary embodiments. Various modifications or reforms can be added to the above-described exemplary embodiments without departing from the scope of the invention, and a configuration having the modifications or reforms added thereto is also included in the technical scope of the present invention.

In the first to fourth embodiments, the description has been given of a case where the drying process is realized by a software configuration, but the present invention is not limited thereto. For example, a configuration may be adopted in which the drying process is realized by a hardware configuration.

A configuration example in this case includes, for example, a configuration in which a functional device that executes the same process as those of the control units 20 and 22 is created and used. In this case, a high-speed process is expected as compared with the above-described embodiments.

Meanwhile, in the embodiments, the description has been given of an example in which ink drops ejected onto the continuous sheet P are dried. However, it is needless to say that a so-called cut sheet, which is cut in advance to a size such as, for example, an A4-size, may be used instead of the continuous sheet P. In addition, a material of a recording medium is not limited to sheet, and any material having a property in which ink drops are fixed onto a recording medium by irradiating the ink drops with a laser may be applied to the disclosed technique.

In addition, an object to be dried by the laser drying device 70 is not limited to ink drops. Any object such as, for example, a resin may be used as long as it can be dried by laser irradiation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a laser element that irradiates an irradiation region with a laser, the irradiation region including a plurality of droplets on a recording medium which are ejected by an ejection unit, ejecting droplets according to an image, along a transport direction of the recording medium and a direction crossing the transport direction;

a plurality of laser element groups that are arranged in the transport direction of the recording medium, each laser element group including a plurality of the laser elements; and a driving unit that drives the laser element group for each laser element group, wherein the drying device dries water-based ink droplets being the plurality of droplets, the driving unit sets an irradiation intensity of a laser emitted from the laser element group for each laser element group by determining a magnitude relation between a front face printing rate and a back face printing rate of the recording medium which is included in the irradiation region corresponding to each of the laser elements of the laser element group, the front face printing rate is a printing rate of the recording medium on a laser irradiation surface included in the irradiation region corresponding to each of the laser elements of the laser element group, and the back face printing rate is a printing rate of the recording medium on a back face of the laser irradiation surface included in the irradiation region corresponding to each of the laser elements of the laser element group.

2. The drying device according to claim 1, wherein the laser element group includes the plurality of laser elements in the transport direction of the recording medium.

3. The drying device according to claim 1, wherein a terminal for connecting the laser element group to the driving unit is disposed at an end of the laser element group in the transport direction of the recording medium.

4. The drying device according to claim 1, wherein the driving unit obtains an irradiation intensity of a laser which is required to dry droplets included in the irradiation region corresponding to each of the laser elements on the basis of the front face printing rate and the back face printing rate, and the driving unit uses a maximum irradiation intensity, out of the irradiation intensities of the laser elements included in the laser element group, as the irradiation intensity of the laser emitted from the laser element group.

5. The drying device according to 1, wherein when the front face printing rate of the recording medium in the irradiation region corresponding to each of the laser elements of the laser element group is less than a front face printing rate requiring laser irradiation, the driving unit drives the laser element group so as to stop the laser emitted from the laser element group.

6. The drying device according to claim 1, wherein the driving unit drives the laser element group so that the irradiation intensity of the laser emitted from the laser element group is decreased as the transport speed of the recording medium decreases.

7. The drying device according to claim 1, wherein when the transport speed of the recording medium is equal to or less than a speed determined in advance, the driving unit drives the laser element group so as to stop the laser emitted from the laser element group.

8. The drying device according to claim 1, wherein the laser element is a laser element in which a plurality of laser emission units are disposed along at least one of the transport direction and a width direction of the recording medium.

9. The drying device according to claim 1, wherein the laser element is a laser element in which a plurality of laser emission units are disposed along at least one of the transport direction and a width direction of the recording medium, the plurality of laser emission units are divided into a plurality of laser emission unit groups, the laser element is a laser element in which the laser emission units included in the laser emission unit group are connected to each other in series and the laser emission unit groups are connected to each other in parallel, and the laser element group is a laser element group in which the laser elements are connected to each other in parallel.

10. An image forming apparatus comprising:

the ejection unit that ejects the droplets according to the image; and the drying device according to claim 1.

11. A non-transitory computer readable medium storing a drying program causing a computer to execute a process for controlling a driving unit, the process comprising:

controlling the driving unit that drives each of a plurality of laser element groups that are arranged in a transport direction of a recording medium, each laser element group including a plurality of laser elements that irradiate an irradiation region with a laser, for each laser element group, the irradiation region including a plurality of water-based ink droplets on the recording medium which are ejected by an ejection unit, ejecting water-based ink droplets according to an image, along the transport direction of the recording medium and a direction crossing the transport direction; and setting an irradiation intensity of a laser emitted from the laser element group for each laser element group by determining a magnitude relation between a front face printing rate and a back face printing rate of the recording medium which is included in the irradiation region corresponding to each of the laser elements of the laser element group, the front face printing rate being a printing rate of the recording medium on a laser irradiation surface included in the irradiation region corresponding to each of the laser elements of the laser element group, and the back face printing rate being printing rate of the recording medium on a back face of the laser irradiation surface included in the irradiation region corresponding to each of the laser elements of the laser element group.

* * * * *